US006206365B1

(12) United States Patent
Nanba et al.

(10) Patent No.: US 6,206,365 B1
(45) Date of Patent: Mar. 27, 2001

(54) SHEET RECEIVING APPARATUS FOR SORTING AND STACKING SHEETS ON A TRAY WITH FRICTION-FREE HORIZONTAL RECIPROCATION

(75) Inventors: Toyoaki Nanba, Higashiosaka; Jinichi Nagata, Osaka; Tomomi Tanaka, Yamatokoriyama; Takehiko Josako; Keiji Tanaka, both of Fukayasu-gun, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/189,708

(22) Filed: Nov. 11, 1998

(30) Foreign Application Priority Data

Nov. 14, 1997 (JP) ..... 9-314001

(51) Int. Cl.[7] ..... B65H 31/10; B65H 31/20

(52) U.S. Cl. ..... 271/217; 271/213; 271/215; 271/224

(58) Field of Search ..... 271/215, 217, 271/224, 213, 214, 233, 248

(56) References Cited

U.S. PATENT DOCUMENTS 4,311,090 * 1/1982 Dudziak et al. ..... 100/3
4,897,017 * 1/1990 Castiglioni ..... 414/790.8
5,056,774 * 10/1991 Kubota et al. ..... 271/213
5,190,281 * 3/1993 Cardenas ..... 271/198
5,318,401 * 6/1994 Mandel ..... 271/217
5,407,188 4/1995 Ida et al. ..... 271/215
5,460,479 * 10/1995 Neumann et al. ..... 414/789.5
5,499,811 * 3/1996 Hayashi et al. ..... 271/293
5,618,035 * 4/1997 Coombs et al. ..... 271/213

* cited by examiner

*Primary Examiner*—Donald P. Walsh
*Assistant Examiner*—Daniel K Schlak
(74) *Attorney, Agent, or Firm*—Renner, Otto, Boisselle & Sklar LLP

(57) ABSTRACT

A sheet post-processing device of the present invention conducts post processing on sheets and then ejects the sheets on an offset tray. Upon the ejection, the sheets are sorted by a sorting drive section reciprocating the offset tray horizontally. The sheets are aligned at the trailing edges thereof by a plurality of sheet edge stopper columns erected freely rotatable. The offset tray is moved vertically along the sheet edge stopper columns by, for example, a lifting and lowering motor. Friction rollers are provided as linking means for rotating the sheet edge stopper columns in accordance with a horizontal movement of the offset tray. As to the horizontal movement and a vertical movement of the offset tray, the friction rollers transmit a driving force to the sheet edge stopper columns only when the offset tray is moved horizontally. Consequently, the stack disturbance of the sheets can be prevented both when the offset tray is moved horizontally and when the offset tray is moved vertically.

8 Claims, 15 Drawing Sheets

SHEET RECEIVING APPARATUS FOR SORTING AND STACKING SHEETS ON A TRAY WITH FRICTION-FREE HORIZONTAL RECIPROCATION

FIELD OF THE INVENTION

The present invention relates to a sheet post-processing device, incorporated in an image forming apparatus that acts as a copying machine, a facsimile, and a printer, for conducting post-processing, such as stapling, on sheets transported from the image forming apparatus and then ejecting them, and more particularly to the prevention of disturbance to the alignment of the sheets ejected onto an ejection tray at the trailing edges thereof.

BACKGROUND OF THE INVENTION

Copying machines nowadays are used in combination with various devices including an automatic document feeder and a sheet post-processing device so as to automatically conduct copying and post-processing operations, such as stapling and punching on the sheets on which images are formed. A sheet post-processing device conducts post-processing such as stapling and punching on each set consisting of a predetermined number of sheets ejected out of a copying machine after images are copied thereon.

U.S. Pat. No. 5,407,188 discloses an example of such a sheet post-processing device.

As shown in FIG. 14, as sheets 101 are ejected via ejection rollers 102 onto an ejection tray 103 after undergoing post-processing, a sheet post-processing device 100 sorts sheets 101 by reciprocating the ejection tray 103 horizontally and at a right angle to the ejection direction of the sheets 101.

The ejection tray 103 is formed so that the sheets 101 are ejected diagonally upward. In addition, freely rotatable sheet edge stopper columns 104 for aligning the trailing edges of the sheets 101 stacked on the ejection tray 103 are erected on the trailing side of the ejection tray 103 with respect to the sheet ejection direction.

The ejection tray 103 is lifted and lowered along the sheet edge stopper columns 104 by a lifting and lowering motor (not shown).

With the sheet post-processing device 100, if while the sheets 101 stacked on the ejection tray 103 are in contact with the sheet edge stopper columns 104, the ejection tray 103 reciprocates to sort a newly ejected sheet 101, the sheet edge stopper columns 104, although freely rotatable, act as immovable objects to the light stacked sheets 101. Consequently, the stacked sheets 101 are disturbed by the friction between the sheets 101 and the sheet edge stopper columns 104.

Since the sheets 101 is light in weight, even if the ejection tray 103 moves horizontally, the sheet edge stopper columns 104 exerts frictional forces on the sheets 101 in such a manner to keep the sheets 101 from moving. Here, if the sheet edge stopper columns 104 rotate in response to the horizontal movement of the ejection tray 103, the alignment of the sheets 101 in the stack can be prevented from being disturbed.

As shown in FIG. 15, the sheet post-processing device 100 disclosed in the above-identified patent application includes a sponge rubber 105 provided to the ejection tray 103 so as to be in touch with, and slide on, the sheet edge stopper columns 104, forcing the sheet edge stopper columns 104 to rotate in response to the horizontal movement of the ejection tray 103.

With the sheet post-processing device 100, when the ejection tray 103 moves horizontally, the sheet edge stopper columns 104 are driven to rotate by the movement of the ejection tray 103. However, when the ejection tray 103 moves vertically, the sheet edge stopper columns 104 exert frictional forces on the ejection tray 103 and interrupt the smooth vertical movement of the ejection tray 103. Consequently, the stacked sheets 101 are disturbed out of alignment.

SUMMARY OF THE INVENTION

In view of the conventional problem detailed above, an object of the present invention is to offer a sheet post-processing device capable of preventing the stacked sheet from being disturbed out of alignment regardless of whether the ejection tray is moved horizontally or vertically.

In order to accomplish the above object, a sheet post-processing device in accordance with the present invention includes:

- an ejection section, provided vertically movable, onto which a sheet on which an image is already formed is ejected after undergoing post processing;
- a sorting drive section for sorting the sheet in the ejection section by reciprocating the ejection section horizontally and at a right angle to an ejection direction of the sheet;
- sheet edge stopper columns, provided to be horizontally freely rotatable, for aligning a trailing edge of the sheet ejected onto the ejection section disposed diagonally upward with respect to the ejection direction; and
- a linking section for rotating the sheet edge stopper columns in accordance with a horizontal movement of the ejection section so as to horizontally move the sheets already aligned, and, when the ejection section is moved vertically, lifting and lowering the ejection section smoothly without rotating the sheet edge stopper columns.

With the sheet post-processing device, sheets on which an image is already formed and which have undergone post processing are ejected onto an ejection section disposed diagonally upward with respect to the ejection direction of the sheet and vertically movable, sorted in the ejection section by a sorting drive section reciprocating the ejection section horizontally and at a right angle to the ejection direction, aligned at the trailing edges thereof by sheet edge stopper columns erected to be horizontally freely rotatable. The sheets are then moved horizontally without disturbing the alignment by a linking section rotating the sheet edge stopper columns in accordance with a horizontal movement of the ejection section, and moved vertically without disturbing the alignment by the linking section not rotating the sheet edge stopper columns but moving the ejection section smoothly when the ejection section is to be moved vertically. Accordingly, the sheets ejected onto the ejection section and sorted thereon in the ejection section become movable without disturbing the alignment both horizontally and vertically.

For a fuller understanding of the nature and advantages of the invention, reference should be made to the ensuing detailed description taken in conjunction with the accompanying drawings.

DESCRIPTION OF THE EMBODIMENTS

[First Embodiment]

Referring to FIGS. 1 through 11, the following description will discuss an embodiment in accordance with the present invention.

Figure 3:
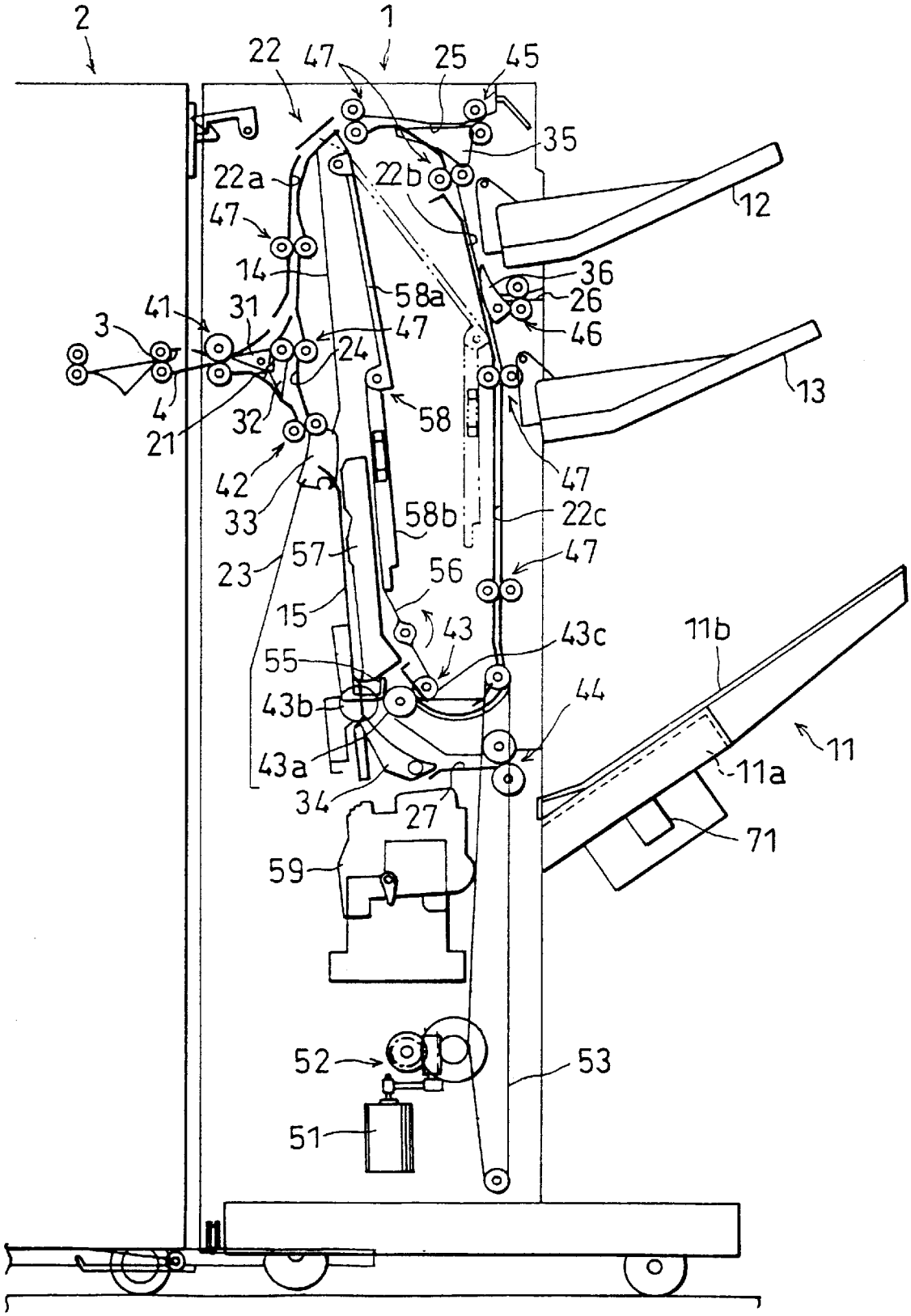
FIG. 3 is a view showing the overall configuration of the sheet post-processing device.

As shown in FIG. 3, a sheet post-processing device 1 of the present embodiment is placed close to a sheet ejection port 3 on a side of a copying machine 2. The copying machine 2 is generally an image forming apparatus and particularly, for example, a copying machine such as a digital copying machine or a digital colour copying machine. The sheet post-processing device 1 conducts post-processing, such as stapling, and then sorts sheets, such as OHP sheets, ejected from the copying machine 2.

Apart from stapling, the post-processing conducted on the sheets by the sheet post-processing device 1 includes punching and pasting. In the present embodiment, however, stapling is taken as an example of the post-processing.

The sheet post-processing device 1 is structured to be movable in the sheet ejection direction and thereby separable from the copying machine 2 when paper jam occurs in the sheet post-processing device 1 or the copying machine 2 and when staples are supplied. When the sheet post-processing device 1 is to be connected to the copying machine 2, diagonal rails provided to the sheet post-processing device 1 mount on guide members of the copying machine 2 to accurately adjust the height of a sheet feeding port 4 of the sheet post-processing device 1 to that of the sheet ejection port 3 of the copying machine 2.

The sheet post-processing device 1 includes an offset tray 11, for example, as an ejection tray (ejection means) vertically movable and offset-sortable, onto which tray a large number of copied and stapled sheets are ejected.

Figure 1:
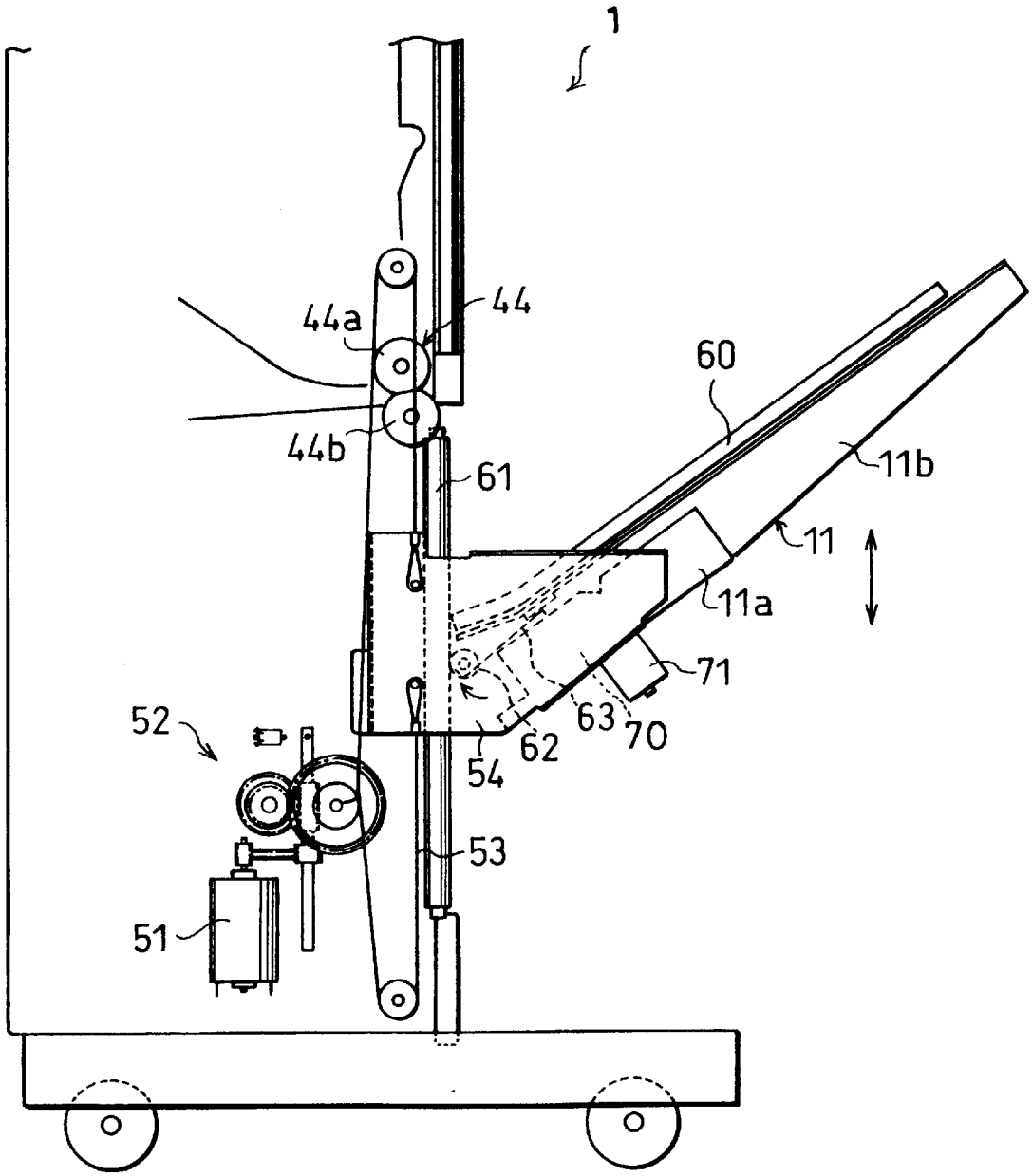
FIG. 1, relating to an embodiment in accordance with the present invention, is a view showing a configuration of a sheet post-processing device including a friction roller pressing a sheet edge stopper column.
Figure 2:
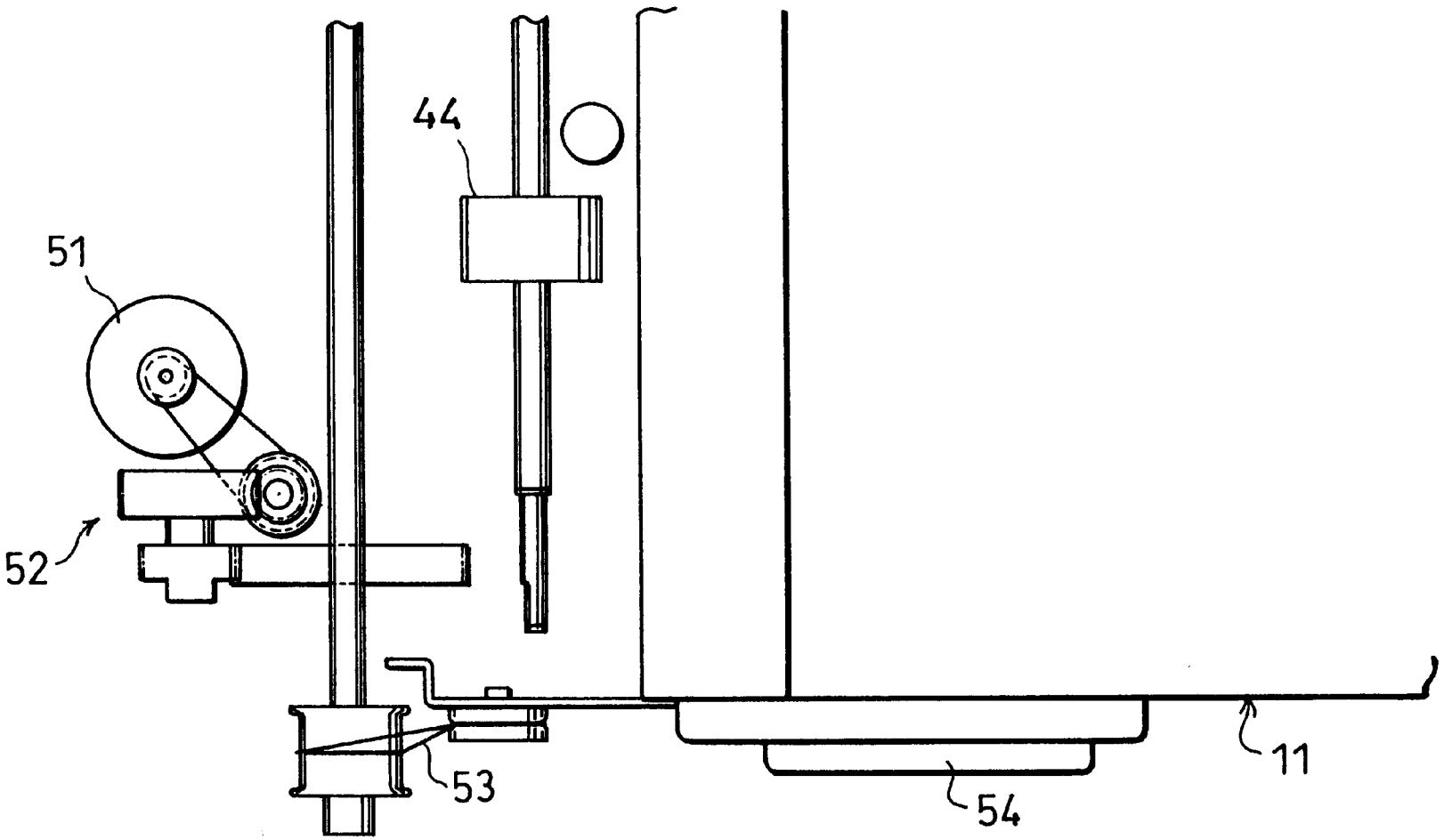
FIG. 2 is a plan view showing vertical driving force transmission system of the sheet post-processing device.

As shown in FIGS. 1 and 2, the offset tray 11 is lifted and lowered as lifting and lowering drive wires 53 and a lifting and lowering driving force transmission system 52 composed of, for example, gears transmit a driving force of a lifting and lowering motor 51. Therefore, the lifting and lowering motor 51, the lifting and lowering driving force transmission system 52, and the lifting and lowering drive wires 53 act as lifting and lowering means.

Figure 4:
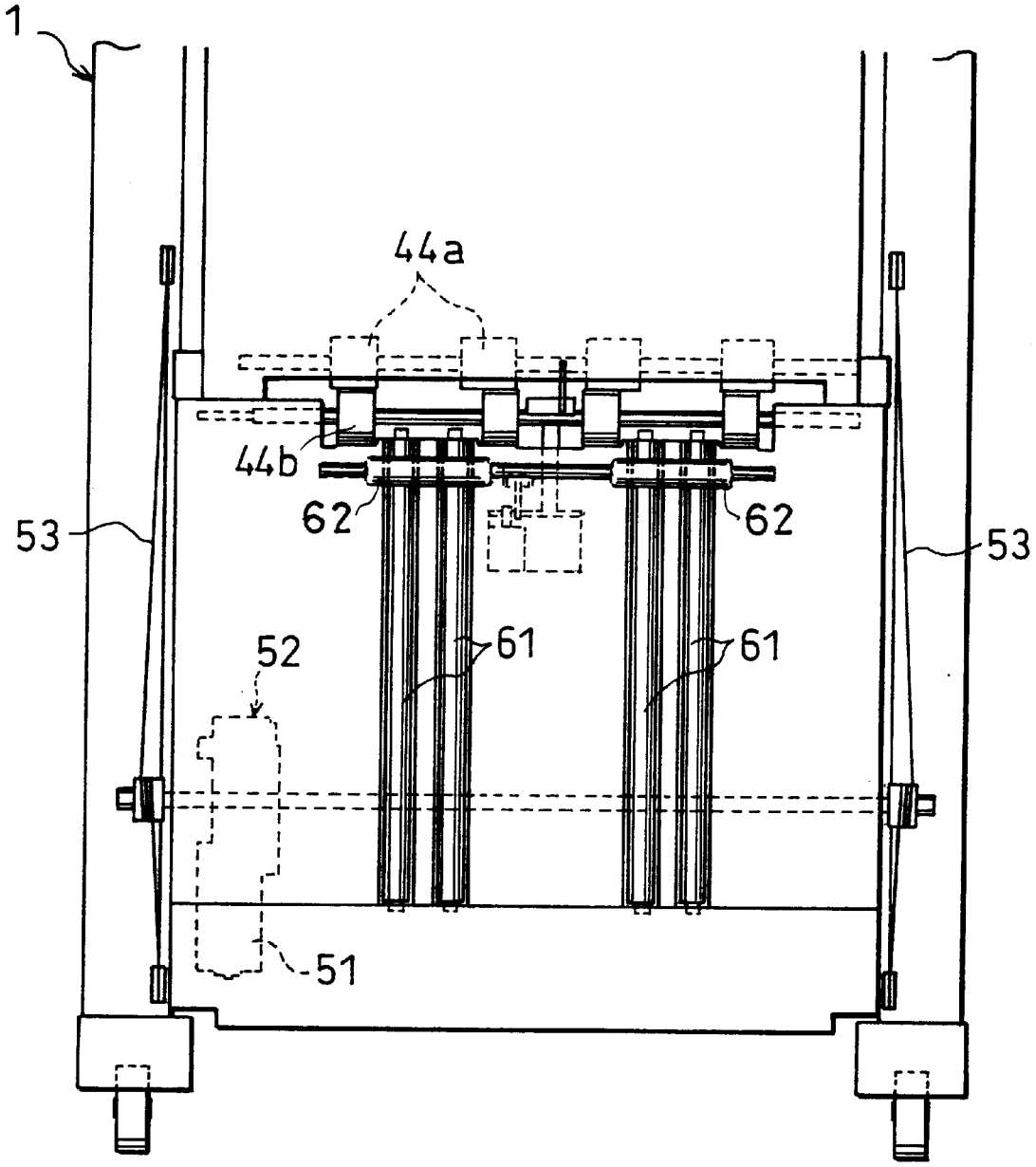
FIG. 4 is a front view of the sheet post-processing device from which an offset tray is removed.

A lifting and lowering drive wire 53 is provided on each side of sheet post-processing device 1 as shown in FIG. 4. The lifting and lowering drive wires 53 are each connected to an offset tray support plate 54 as shown in FIG. 1, and the offset tray support plates 54 are in turn connected to an offset tray reinforcement section 11*a* of the offset tray 11.

Thereby, as the lifting and lowering motor 51 drives and thus lifts and lowers, via the lifting and lowering driving force transmission system 52 and the lifting and lowering drive wires 53, the offset tray 11 of which the offset tray reinforcement section 11*a* is a part.

The offset tray 11 is made of two tiers, one being the offset tray reinforcement section 11*a* and the other being an offset tray plate 11*b* attached onto the offset tray reinforcement section 11*a*. The offset tray plate 11*b* is attached to be horizontally movable to the offset tray reinforcement section 11*a* and driven by an offset motor 71 disposed below the offset tray reinforcement section 11*a* to reciprocate horizontally and at a right angle to the transportation direction of the sheets.

Figure 5:
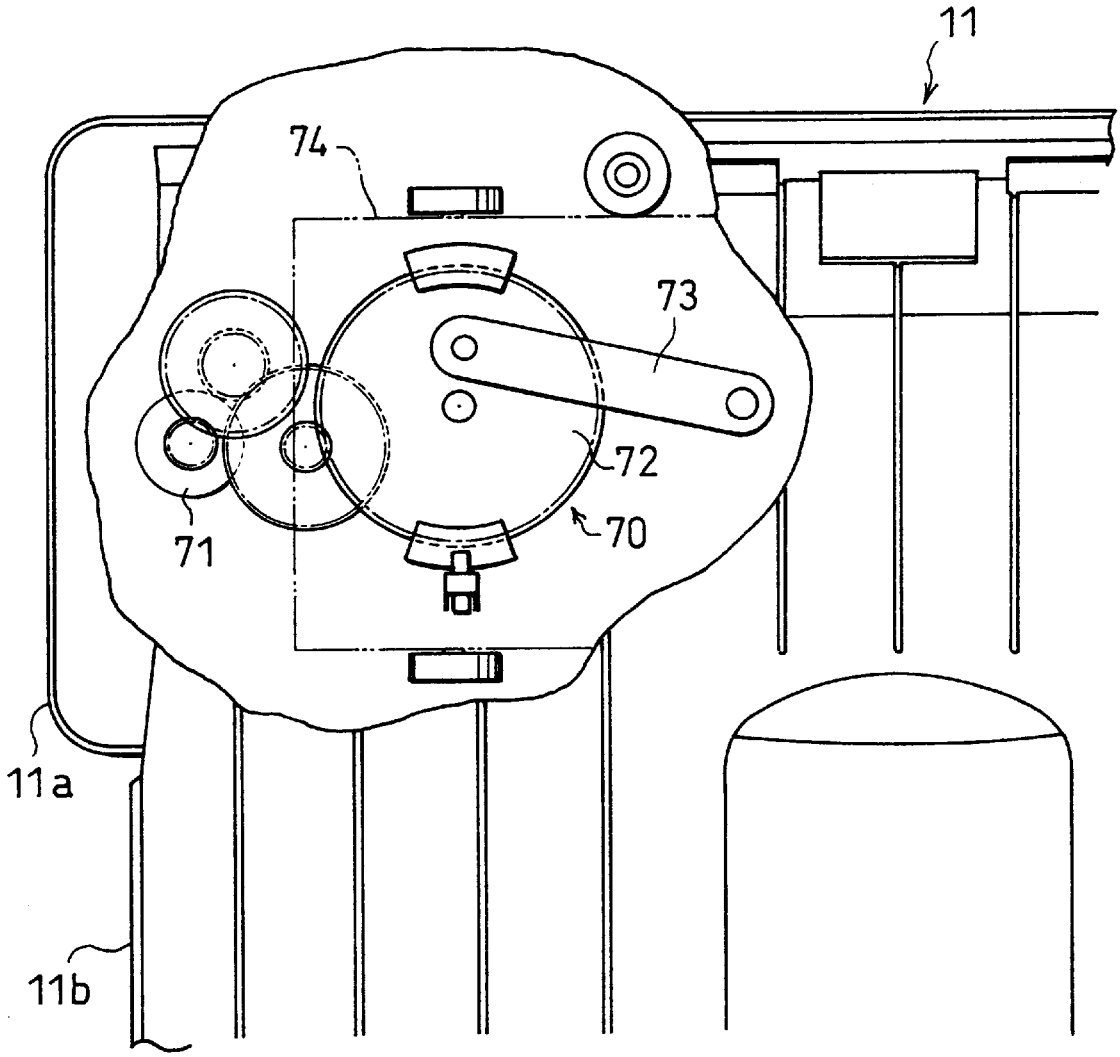
FIG. 5 is a plan view showing a configuration of a sorting drive section provided inside an offset tray, by partially cutting away the offset tray.
Figure 6:
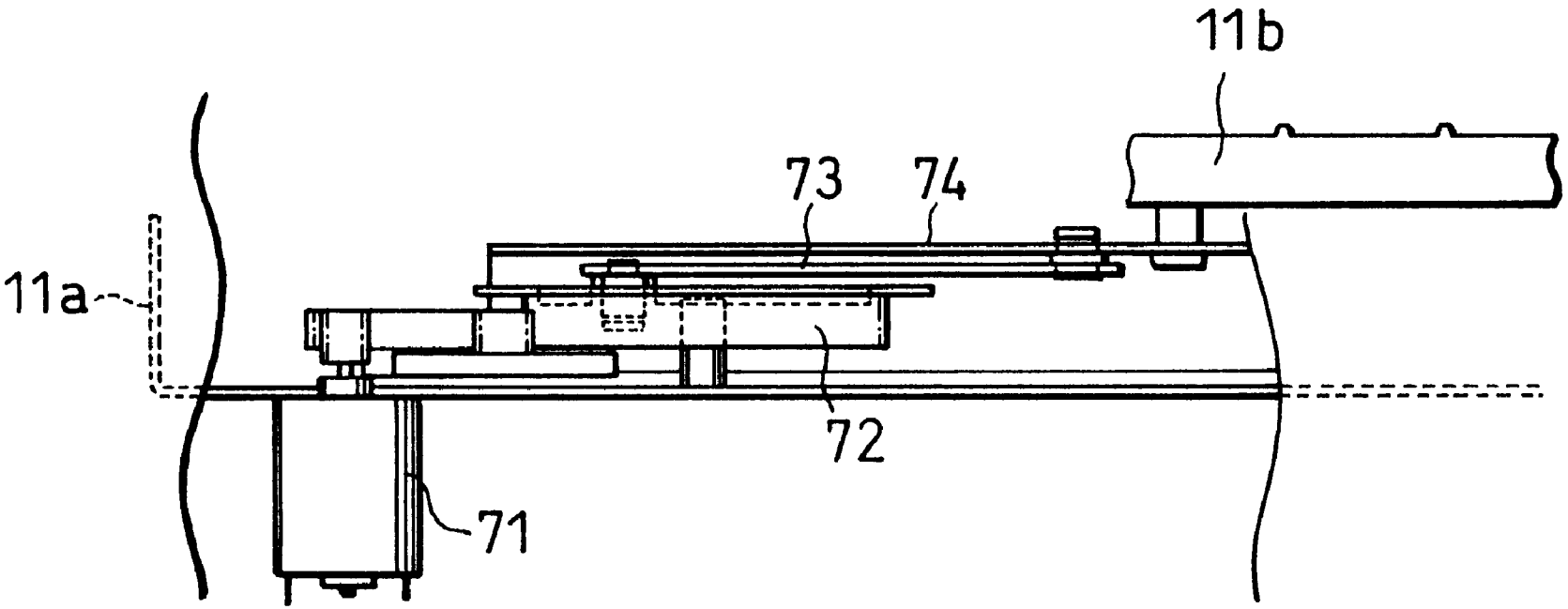
FIG. 6 is a front view showing a configuration of a sorting drive section provided inside an offset tray, by partially cutting away the offset tray.

Specifically, as shown in FIGS. 5 and 6, the offset tray reinforcement section 11*a* houses a sorting drive section 70 as sorting means composed of gears and a crank. The crank is composed of a major gear 72 and a connecting plate 73 supported by, and pivoted around, the major gear 72. An offset stay 74 is attached to the upper side of the connecting plate 73 at the other end of the connecting plate 73 so as to be freely movable horizontally. The offset tray plate 11*b* is attached to the offset stay 74.

Consequently, the offset motor 71 drives and rotates the major gear 72 via the gears, which in turn moves the offset stay 74 and the offset tray plate 11*b* horizontally via the connecting plate 73.

As a result, when sets or bundles of sheets are ejected and offset-sorted, the ejected sets or bundles are piled with alternate sets or bundles shifted to the right and left, by moving the offset tray plate 11*b* to the right and left alternately every time a set or bundle is ejected. Therefore, the sorting of bundles of sheet becomes extremely easier, especially when the bundles are not stapled.

Meanwhile, as shown in FIG. 3, the sheet post-processing device 1 has two fixed trays, i.e. an upper fixed tray 12 and a lower fixed tray 13, as well as the offset tray 11. The copying machine 2 used in the present embodiment works in copy mode and other operation mode including fax mode and print mode. For example, the upper fixed tray 12 is designated as an ejection tray in fax mode, and the lower fixed tray 13 is designated as an ejection tray in print mode.

The sheet post-processing device 1 houses paths used in variable combinations according to, for example, the size of ejected sheets, the need of stapling operation, the need of reverse ejection, and the selection of an ejection tray. Desirable paths are selected from those paths and combined to form a transport path along which the sheets are processed as required and then ejected.

The paths are, specifically, composed of a direct path 21, a detour path 22, a reverse path 23, a linking path 24, an upper fixed tray ejection path 25, a lower fixed tray ejection path 26, an offset tray ejection path 27, a lower staple tray 15.

The direct path 21 extends downward from the sheet feeding port 4, passes through reverse rollers 42, and as explained in detail below, further extends to a space between an upper staple tray 14 and the lower staple tray 15, both trays extending vertically. The sheet ejected from the copying machine 2 is directed through the direct path 21 to pass through the reverse rollers 42 and reaches the lower staple tray 15.

The detour path 22 extends upwards from the sheet feeding port 4, skirts around the top edge of the upper staple tray 14, extends downward along the side of the sheet post-processing device 1 close to the trays, curves before the offset tray 11, and reaches the bottom edge of the lower staple tray 15. Between the sheet feeding port 4 and the bottom edge of the lower staple tray 15, the detour path 22 is divided into three segmented detour paths 22*a* to 22*c*. The upper fixed tray ejection path 25 branches out at the connection point of the detour path 22*a* and the detour path 22*b* so as to guide and eject the sheet onto the upper fixed tray 12. The lower fixed tray ejection path 26 branches out at the connection point of the detour path 22*b* and the detour path 22*c* so as to guide and eject the sheet onto the lower fixed tray 13.

The reverse path 23 extends almost vertically close to the copying machine 2 from near the space between the upper staple tray 14 and the lower staple tray 15 near the reverse rollers 42 disposed at the bottom end of the direct path 21. Therefore, the sheet guided by the direct path 21 can be transported either to the lower staple tray 15 or to the reverse path 23. The sheet guided to the reverse path 23 is sent to the detour path 22 via the linking path 24 as being reversed by the reverse rollers 42. Therefore, the reverse path 23 and the linking path 24 form a switch back path for the sheet that travels along the detour path 22.

The offset tray ejection path 27 extends below the detour path 22 from the bottom edge of the lower staple tray 15. The sheet exported from the bottom edge of the lower staple tray 15 is guided by the offset tray ejection path 27 and ejected onto the offset tray 11.

The switching of the paths is conducted by switching gates located at branching points of the paths and switching the direction of the rotation of transport rollers, which will be explained in detail later.

The lower staple tray 15 is a part of a staple tray as a vertically extending post-processing tray on which the sheets to be stapled are temporarily stacked. In the present embodiment, the lower staple tray 15 is used as a path composing a part of the transport path.

So, in the present embodiment, the staple tray is erected almost vertically with the upper staple tray 14 and the lower staple tray 15 being separated in an upper part of the sheet post-processing device 1. Since there is provided the space between the upper staple tray 14 and the lower staple tray 15, the sheet can be transported passing through the space from direct path 21 to the lower staple tray 15 as mentioned above.

To be stapled in the sheet post-processing device 1, the sheets are stacked on the staple tray with the lower edges of the sheets being placed on, and aligned by, a sheet support table 55. However, in some cases, the sheets transported onto the staple tray are not aligned well on the sheet support table 55 due to static electricity or some other reasons. To prevent this from happening, each time a sheet is transported, a paddler 56 rotates (anti-clockwise in FIG. 3) and thus exerts a downward transportation force onto the sheet to be surely aligned with the other sheets. The paddler 56 has a flexible blade made of an elastic material such as rubber to exert the transportation force onto the sheet. The paddler 56 rotates a turn each time one sheet is transported onto the staple tray.

As to the side ends of the sheets placed on the sheet support table 55, the sheets are aligned by an alignment plate 57 as the alignment plate 57 holds the sheets at the side ends thereof. Since the staple tray extends both upward and downward and holds the stacked sheets only on one side on the upper staple tray 14 as mentioned above, the sheets may possibly fall off the staple tray.

To prevent this from happening, a sheet guide section 58 is provided at least near the upper edge of the stacked sheets so that the sheet guide section 58 together with the staple tray sandwiches and thus holds the sheets. The sheet guide section 58 is composed of two interconnected plates 58*a* and 58*b* and can be manually withdrawn to a retreat position when paper jamming is to be solved.

A stapler 59 is disposed below the staple tray. As a predetermined number of sheets are stacked on the sheet support table 55, the sheet support table 55 is lowered to a stapling position of the stapler 59 with the sheets being held thereon. The sheets stapled by the stapler 59 are lifted while being held by the sheet support table 55 to return to the position of the staple tray. The sheets are then ejected onto the offset tray 11 via the offset tray ejection path 27 as the sheet support table 55 is lowered.

With the sheet post-processing device 1 configured as above, the operations of the gates and transportation rollers are controlled according to operation mode of the copying machine 2, size of the sheet fed, etc. to switch between the transportation paths. The following description will explain the operations of the sheet post-processing device 1 in various modes of the copying machine 2.

[Copy Mode Operations]

When the copying machine 2 is in copy mode and a predetermined number of sheets ejected from the copying machine 2 are to be stapled, a transportation path is selected in sheet post-processing device 1 according to whether or not the sheet is larger than the letter size (landscape A4).

First, a case will be explained where the sheet is not larger than the letter size. In the case, the sheet is transported via the direct path 21, the staple tray (only the lower staple tray 15), and the offset tray ejection path 27 to the offset tray 11 in FIG. 7.

As shown in FIG. 3, the sheet ejected from the sheet ejection port 3 of the copying machine 2 is fed via the sheet feeding port 4 of the sheet post-processing device 1 into the direct path 21 inside the sheet post-processing device 1 by sheet feeding rollers 41. Thereafter, the sheet is transported from the direct path 21 to the lower staple tray 15 by the reverse rollers 42. The reverse rollers 42 can be switched to rotate both forward and backward. As the reverse rollers 42 rotate forward, the sheet is fed from the direct path 21 to the lower staple tray 15 or to the reverse path 23. As the reverse rollers 42 rotate backward, the sheet is fed from the direct path 21 to the detour path 22 via the linking path 24.

Near the sheet feeding rollers 41 and the reverse rollers 42, right after the sheet feeding roller 41 is provided a sheet feeding gate 31 for switching the transportation path of the fed sheet between the direct path 21 and the detour path 22, and right before the reverse rollers 42 is provided a reverse gate 32 switched according to whether the reverse rollers 42 rotate forward or backward. Right after the reverse rollers 42 is provided a switching gate 33 for switching the transportation path of the sheet between the lower staple tray 15 and the reverse path 23 when the reverse rollers 42 are rotating forward.

So, when the copying machine 2 is in copy mode and sheets not larger than the letter size are to be stapled, the sheet feeding gate 31, the reverse gate 32, and the switching gate 33 are switched to respective positions shown in FIG. 8(*a*).

Figure 9:
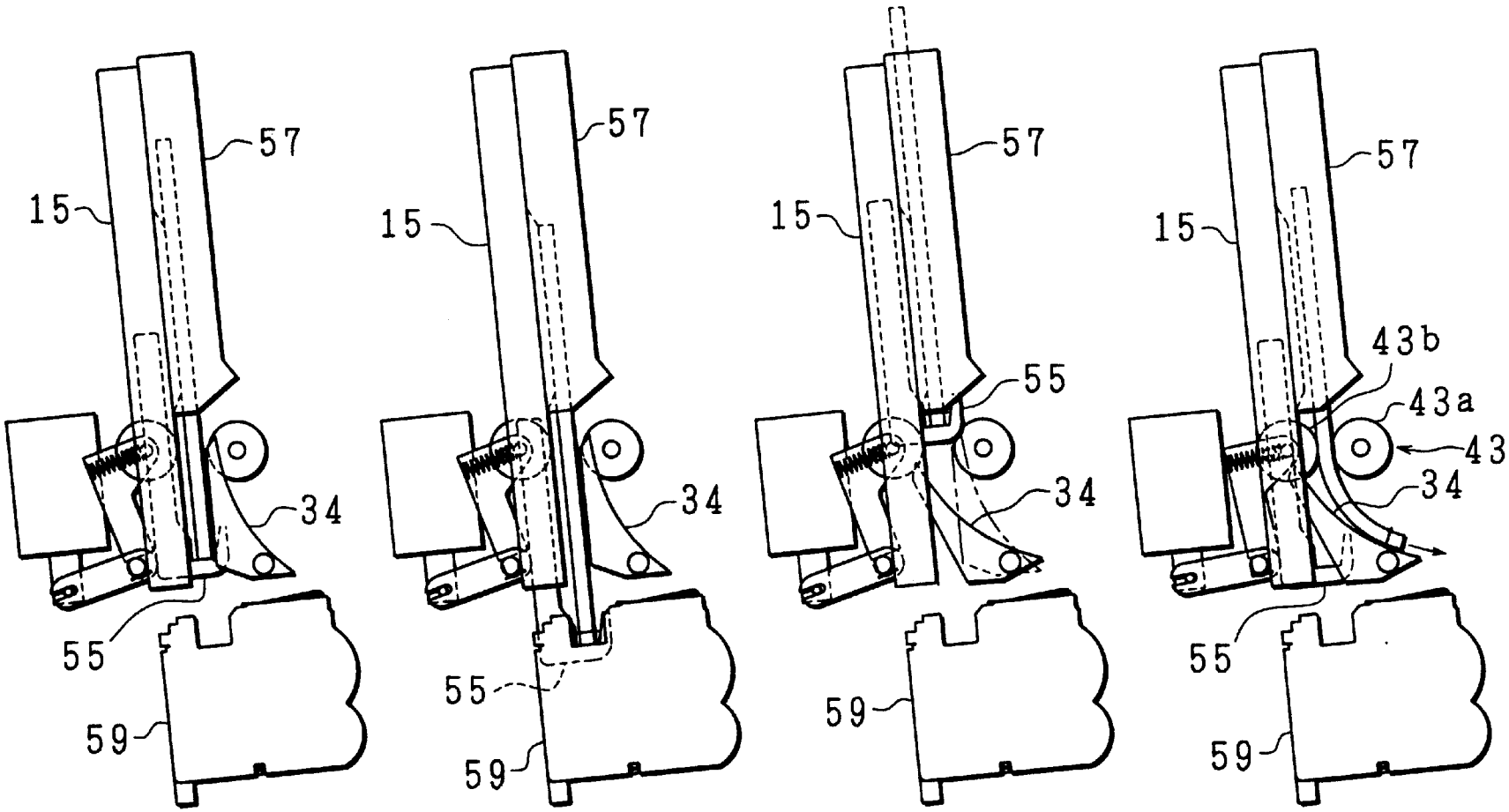
FIGS. 9(*a*) to 9(*d*) are explanatory drawings showing operations of stapling a set of sheets, FIG. 9(*a*) showing a set of sheets waiting to be stapled while being stacked on a lower staple tray, FIG. 9(*b*) showing the set of sheets lowered by a sheet support table to be stapled, FIG. 9(*c*) showing the set of sheets lifted by the sheet support table after being stapled, FIG. 9(*d*) showing the set of sheets ejected onto an offset tray after being stapled.

The sheet transported along the direct path 21 is guided by the switching gate 33 to pass through the space between the upper staple tray 14 and the lower staple tray 15, and as shown in FIG. 9(*a*) stacked on the lower staple tray 15 from the upper part of the lower staple tray 15. Here, since the sheet is smaller than the letter size, the sheet fits well onto the lower staple tray 15.

As a predetermined number of sheets are stacked in this manner, the sheet support table 55 is lowered to move the sheets to the stapler 59 and stapled as shown in FIG. 9(*b*). Here, a switching gate 34 is switched to a position for transport the sheets to the stapler 59. The switching gate 34 is provided after the lower staple tray 15 to switch the sheet transportation destination between the offset tray 11 and the stapler 59.

As the sheets are stapled by the stapler 59, the sheet support table 55 is lifted to a position higher than the switching gate 34 as shown in FIG. 9(*c*). Thereafter the switching gate 34 is switched to a position for ejecting the sheets to the offset tray 11. Under these conditions, the sheets are then sent out to the offset tray ejection path 27 by lowering the sheet support table 55 and rotating transportation rollers 43 located before the switching gate 34 to press and move the sheets as shown in FIG. 9(*d*). The sheets are then ejected onto the offset tray 11 via the offset tray ejection path 27 by a sheet discharge roller 44 as a sheet ejection roller.

The transportation rollers 43 include a drive roller 43*a* and two auxiliary rollers 43*b* and 43*c*. The drive roller 43*a* and the auxiliary roller 43*b* are used to move the sheets to the offset tray ejection path 27. The auxiliary roller 43*c* is used together with the drive roller 43*a* to move the sheets transported along the detour path 22 to the staple tray. The auxiliary roller 43*b*, being separable from the drive roller 43*a*, is withdrawn to a retreat position and make way for the sheets when the sheets are moved to the stapler 59.

Next, a case will be explained where the sheet is larger than the letter size. In the case, the sheet is transported via the direct path 21, the reverse path 23, the linking path 24, the detour path 22, the staple tray (both the upper staple tray 14 and the lower staple tray 15), and the offset tray ejection path 27 to the offset tray 11 in FIG. 7.

As shown in FIG. 3, the sheet fed from the copying machine 2 is transported via the direct path 21 to the reverse path 23. Here, the sheet feeding gate 31, the reverse gate 32, and the switching gate 33 are switched to respective positions shown in FIG. 8(*b*).

As the sheet is fed into the reverse path 23 and the trailing edge thereof passes the reverse gate 32, the reverse gate 32 is switched to a position for feeding the sheet from the reverse path 23 to the detour path 22 as shown in FIG. 8(*c*), and at the same time the reverse rollers 42 is switched to rotate backward. Thus, the sheet fed from the copying machine 2 is switched back by the reverse path 23 and fed into the detour path 22 via the linking path 24.

Note in the present embodiment that the trailing edge of a sheet refers to the trailing edge of the sheet when it is ejected from the copying machine 2 and also that the leading edge of a sheet refers to the leading edge of the sheet when it is ejected from the copying machine 2. In other words, after being switched back by the reverse path 23, the sheet is transported along the detour path 22 with the trailing edge thereof at front.

The sheet is switched back by the reverse path 23 before being fed into the detour path 22 for the following reason. When the copying machine 2 is in copy mode, the copying machine 2 ejects the sheets starting with the last page. So the sheets need be stacked on the staple tray with the front sides thereof up, and in other words, every sheet needs to be stacked always with the image forming side up. If the sheets ejected from the copying machine 2 were stacked on the staple tray in the sheet post-processing device 1 of the present embodiment after directly being transported along the detour path 22, the front sides would be all down. Therefore, in the sheet post-processing device 1, the sheets are switched back by the reverse path 23 before being fed into the detour path 22 and thereby stacked on the staple tray with the front sides thereof up.

The sheets fed to the detour path 22 is transported along the entire length of the detour path 22 and fed to the staple tray by the drive roller 43*a* and the auxiliary roller 43*c* at the lower part of the lower staple tray 15. Here, since the sheet is larger than the letter size, the sheets are stacked held by both the upper staple tray 14 and the lower staple tray 15.

So when the sheet is larger than the letter size, if the direct path 21 was used to transport the sheet to the staple tray, the sheet could not fit onto the lower staple tray 15 due to the excessively large size thereof and cause a transportation jam in the direct path 21. So when that is the case, the detour path 22 is used to transport the sheet to the staple tray.

The process after the sheets are stacked on the staple tray is the same as in the case where the sheets are not larger than the letter size, and therefore the explanation thereof is omitted.

Figure 7:
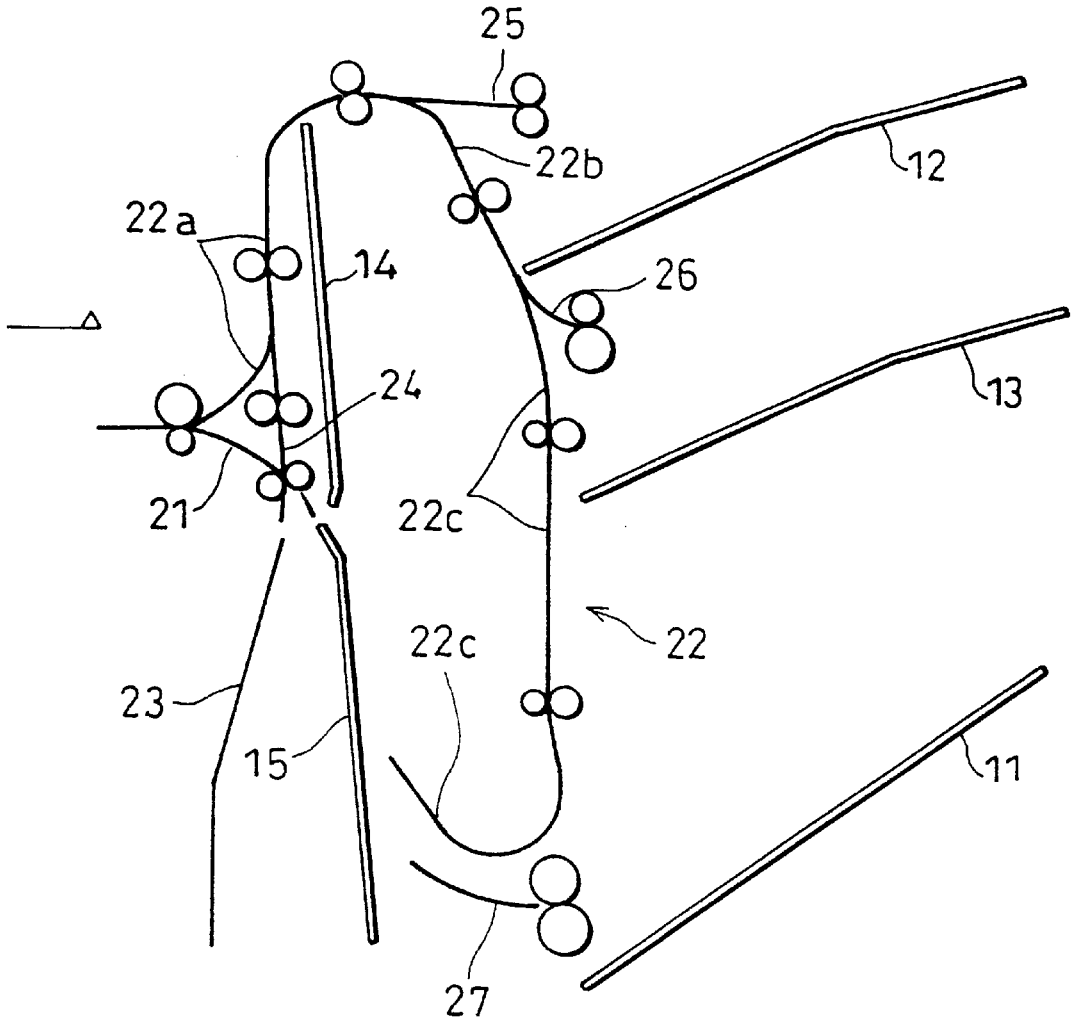
FIG. 7 is an explanatory view showing a configuration of paths in the sheet post-processing device.
Figure 8A:
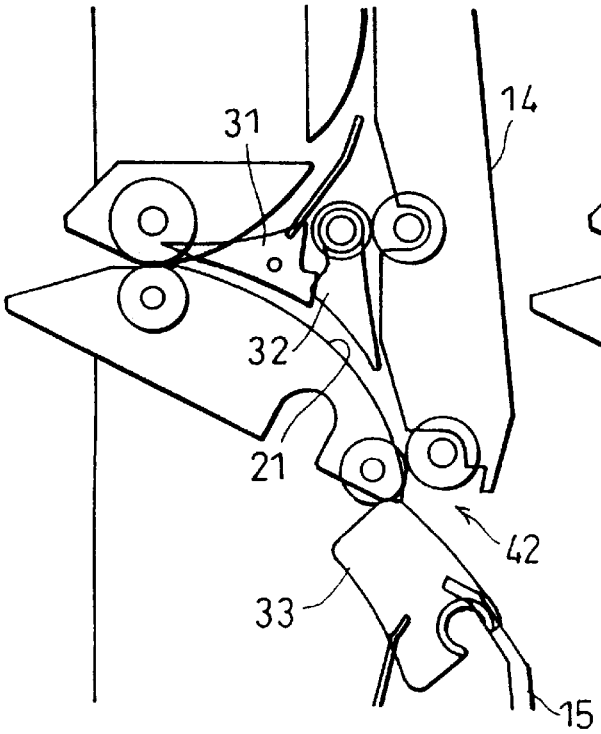
FIGS. 8(*a*) to 8(*d*) are explanatory drawings showing various switching states of a sheet feeding gate, a reverse gate, and a switching gate of the sheet post-processing device, FIG. 8(*a*) showing the gates feeding a sheet from a copying machine into a lower staple tray, FIG. 8(*b*) showing the gates feeding a sheet from the copying machine into a reverse path, FIG. 8(*c*) showing the gates feeding a sheet into a reverse path, switch-backing the sheet, and feeding the sheet into a detour path via a linking path, FIG. 8(*d*) showing the gates feeding a sheet from the copying machine directly into the detour path.
Figure 8B:
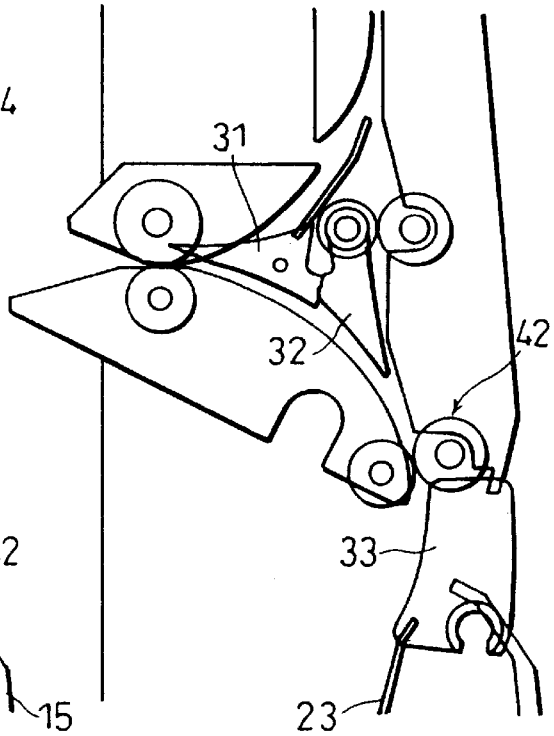
Figure 8C:
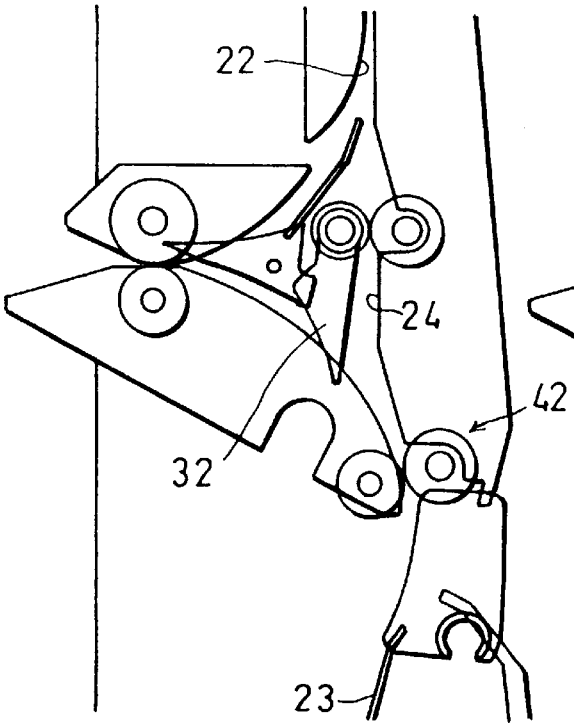
Figure 8D:
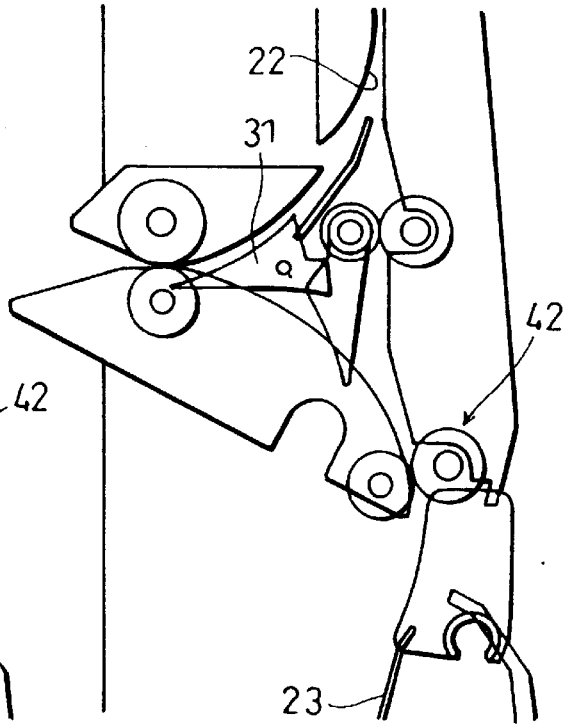

When the copying machine 2 is in copy mode and the sheets are not stapled, the sheet is transported via the direct path 21, the staple tray (only the lower staple tray 15), and the offset tray ejection path 27 to the offset tray 11 in FIG. 7 regardless of the size of the sheet.

In this case, the sheets fed from the copying machine 2 do not need to be stacked on the lower staple tray 15 and are ejected onto the offset tray 11 one by one. Therefore, the sheet support table 55 remains lowered and the switching gate 34 remains to be in the ejection position to the offset tray 11.

[Fax Mode and Print Mode Operations]

As explained earlier, when the copying machine 2 is in fax mode, the sheets ejected from the copying machine 2 are ejected onto the upper fixed tray 12, and when the copying machine 2 is in print mode, the sheets ejected from the copying machine 2 are ejected onto the lower fixed tray 13. Although in copy mode the sheets are normally ejected with the front sides thereof up starting with the last page. In fax mode and print mode the sheets are ejected starting with the first page.

For this reason, if the sheets were ejected with the front sides thereof up in the same manner as in copy mode, the page order would be reversed after the ejection. Therefore, in fax mode and print mode, the sheets are switched back before being ejected onto a tray and thereby ejected with the front sides thereof down.

So, when the copying machine 2 is in fax mode, the sheet is transported via the direct path 21, the reverse path 23, the linking path 24, the detour path 22*a*, and the upper fixed tray ejection path 25 to the upper fixed tray 12 in FIG. 7. When the copying machine 2 is in print mode, the sheet is transported via the direct path 21, the reverse path 23, the linking path 24, the detour path 22*a*, the detour path 22*b*, and the lower fixed tray ejection path 26 to the lower fixed tray 13 in FIG. 7.

As explained above, in fax mode and print mode, the sheet fed from the copying machine 2 is transported to the reverse path 23 to be switched back thereby, and then transported to the detour path 22. The operations of the sheet post-processing device 1 here are the same as the copy mode operations when sheets larger than the letter size are stapled.

The sheet thus transported to the detour path 22 is ejected to the upper fixed tray 12 or the lower fixed tray 13 halfway through the detour path 22 as shown in FIG. 3. That is, in fax mode, the sheet is transported along the detour path 22 and directed to the upper fixed tray ejection path 25 by the switching of a sheet discharge gate 35 to be ejected onto the upper fixed tray 12 by the sheet discharge rollers 45. In print mode, the sheet is transported along the lower fixed tray ejection path 26 by the switching of a sheet discharge gate 36 to be ejected onto the lower fixed tray 13 by the sheet discharge rollers 46.

Since if the copying machine 2 has capacious memory to temporarily store all the transmitted image data, and therefor is capable of printing and ejecting the sheets in reverse order starting with the last page, the sheets do not need to be switched back, the sheets fed from the copying machine 2 only need be transported directly to the detour path 22 from the sheet feeding port 4 without passing through the reverse path 23 and ejected onto either the upper fixed tray 12 or the lower fixed tray 13. In that case, the sheet feeding gate 31 is switched to the position shown in FIG. 8(*d*).

When the sheets are to be stapled in fax mode and print mode, the transportation path in the sheet post-processing device 1 differs also depending upon whether or not the copying machine 2 has memory.

Since if the copying machine 2 has memory, the sheets are printed and ejected starting with the last page in the same manner as in copy mode, the transportation path in the sheet post-processing device 1 is the same as in copy mode. So if the sheet is not larger than the letter size, the sheet is transported via the direct path 21, the staple tray (only the lower staple tray 15), and the offset tray ejection path 27 to the offset tray 11, and if the sheet is larger than the letter size, the sheet is transported via the direct path 21, the reverse path 23, the linking path 24, the detour path 22, the staple tray (both the upper staple tray 14 and the lower staple tray 15), and the offset tray ejection path 27 to the offset tray 11. The rollers and gates are switched in the same manner as in copy mode.

If the copying machine 2 has no memory, the sheets are printed and ejected starting with the first page. Therefore, the sheets stacked on the staple tray need be stacked with the front sides thereof down. Here, if the direct path 21 is used to feed the sheets directly to the lower staple tray 15, the sheets cannot be stacked with the front sides thereof down. Therefore, in this case, the detour path 22 is used to feed the sheets to the staple tray regardless of the sheet size.

So, in this case, the sheet is transported via the detour path 22, the staple tray (either only the lower staple tray 15 or both the upper staple tray 14 and the lower staple tray 15), and the offset tray ejection path 27 to the offset tray 11 in FIG. 7.

It should be noted that even if the copying machine 2 has memory, the image data to be stored in the memory may exceed the memory capacity. If this is the case, since the copying machine 2 ejects the sheets starting with the first page, the major gear 72 operates in the same manner as in the case where the copying machine 2 has no memory.

Explained above is the transportation paths in the sheet post-processing device 1 according to the operation mode of the copying machine 2.

Here, the sheet post-processing device 1 further includes the following feature arrangements.

With the sheet post-processing device 1 of the present embodiment, as shown in FIGS. 1 and 4, sheet edge stopper columns 61 made of, for example, metal bars are erected below the sheet discharge rollers 44 composed of the sheet discharge roller 44*a* and the sheet discharge roller 44*b*. The sheet edge stopper columns 61 get in touch with the sheets 60 stacked on the offset tray 11 disposed diagonally upward with respect to the ejection direction of the sheets 60, and thus align the sheets 60 at the trailing edges thereof.

In other words, since the offset tray 11 is disposed diagonally upward with respect to the ejection direction, the sheets 60 stacked on the offset tray 11 come in touch with the sheet edge stopper columns 61 at the trailing edges thereof and are thus aligned.

Meanwhile, when the offset tray 11 is lifted and lowered by the lifting and lowering motor 51, the lifting and lowering driving force transmission system 52, and the lifting and lowering drive wires 53, the offset tray 11 is moved vertically along the sheet edge stopper columns 61.

The sheet edge stopper columns 61 are provided with friction rollers 62 disposed freely rotatable and at a right angle to the sheet edge stopper columns 61. The friction roller 62 is made of an elastic body such as rubber and presses the sheet edge stopper columns 61 with a flat spring 63 as pressing means attached to the offset tray plate 11*b* of the offset tray 11.

The friction roller 62 has a function of linking means that relays the horizontal movement of the offset tray plate 11*b* of the offset tray 11 to sheet edge stopper columns 61 and thus rotates the sheet edge stopper columns 61. As to the horizontal movement of the offset tray plate 11*b* and the vertical movement of the offset tray 11, the friction roller 62 transmits the driving force of the offset tray plate 11*b* alone.

Figure 10:
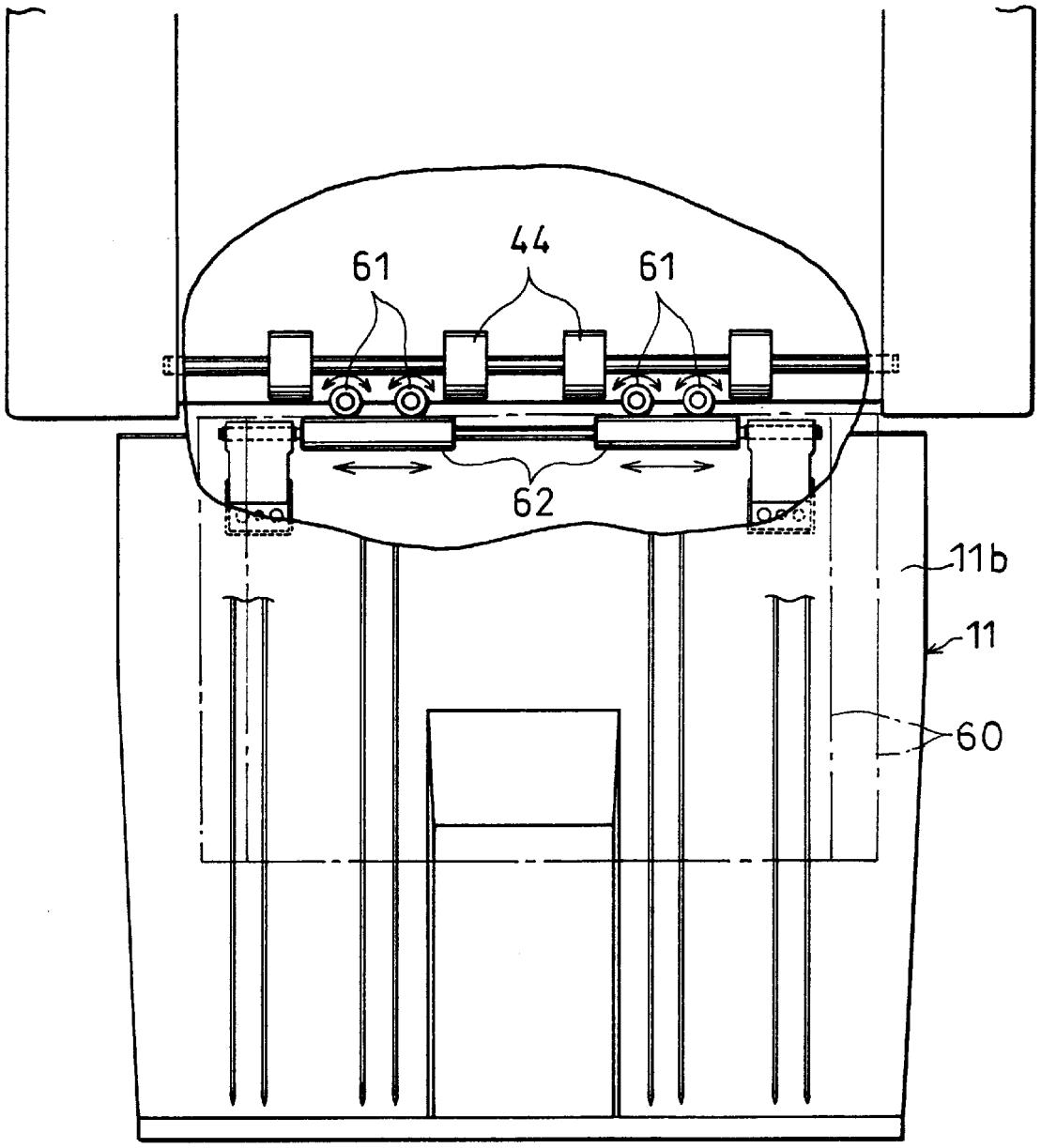
FIG. 10 is a plan view showing positions of a sheet edge stopper column and a friction roller of the sheet post-processing device, by partially cutting away the sheet post-processing device.

As a result, when the offset tray plate 11*b* is moved horizontally, the sheet edge stopper columns 61 are rotated by way of friction with the friction rollers 62 in accordance with the horizontal movement of the offset tray plate 11*b* as shown in FIG. 10. So, when the offset tray plate 11*b* is moved horizontally, the sheets 60 stacked on the offset tray plate 11*b* in touch with the sheet edge stopper columns 61 are moved horizontally by the rotation of the sheet edge stopper columns 61, and are thereby moved horizontally and remain aligned.

By contrast, when the offset tray 11 is moved vertically, the friction rollers 62 are in touch with the sheet edge stopper columns 61 and are thereby rotated by the sheet edge stopper columns 61 as shown in FIG. 1. So the offset tray 11 is moved vertically smoothly.

Since the friction rollers 62 press the sheet edge stopper columns 61 with the flat spring 63, even if the attachment precision of the friction rollers 62 to the sheet edge stopper columns 61 is not good enough, the driving force is surely transmitted when the offset tray plate 11*b* is moved horizontally and when the offset tray 11 is moved vertically.

In this manner, with the sheet post-processing device 1 of the present embodiment, the sheet 60 ejected from the copying machine 2 is post-processed and ejected onto the offset tray 11. When the sheet 60 is ejected onto the ejection tray, the sorting drive section 70 reciprocating the offset tray plate 11*b* of the offset tray 11 horizontally and at a right angle to the ejection direction of the sheet 60. The sheets 60 are sorted since the sheets 60 are stacked alternately shifted to the right and left on the offset tray plate 11*b* of the offset tray 11.

Moreover, since the offset tray 11 is disposed diagonally upward with respect to the ejection direction of the sheet 60, the sheet 60 stacked on the offset tray 11 slides down due to the weight of its own and finally comes in touch with the sheet edge stopper columns 61 erected behind the offset tray 11 with respect to the sheet ejection direction. As a result, the sheets 60 are aligned at the trailing edges thereof.

Here, when the offset tray plate 11*b* of the offset tray 11 is moved horizontally by the sorting drive section 70, the driving force of the linking means composed of, e.g., the friction rollers 62 is transmitted to the sheet edge stopper columns 61 in accordance with the horizontal movement of the offset tray plate 11*b*, and thus rotates the sheet edge stopper columns 61. Therefore, the sheets 60 stacked on the offset tray plate 11*b* of the offset tray 11 in touch with the sheet edge stopper columns 61 are moved horizontally by the rotation of the sheet edge stopper columns 61. The velocity of the horizontal movement of the sheets 60 is equal to the velocity of the horizontal movement of the offset tray plate 11*b*. Therefore, the sheets 60 stacked on the offset tray plate 11*b* of the offset tray 11 are not interrupted from moving horizontally by frictional resistance with the sheet edge stopper columns 61, and thereby moved horizontally easily in accordance with the horizontal movement of the offset tray plate 11*b*. Consequently, the stack disturbance of the sheets 60 can be prevented when the offset tray plate 11*b* is moved horizontally.

On the other hand, as to the horizontal movement and the vertical movement of the offset tray 11, the liking means such as the friction rollers 62 transmits a driving force to the sheet edge stopper columns 61 only when the offset tray 11 is moved horizontally. Therefore, when the offset tray 11 is moved vertically by the lifting and lowering means, the driving force for the vertical movement of the offset tray 11 is not transmitted to the sheet edge stopper columns 61.

In other words, the offset tray 11 and the sheet edge stopper columns 61 lose mutual interconnection as the transmission link is cut off therebetween. Therefore, the offset tray 11, when moved vertically, does not have conventionally existent frictional resistance produced by the engagement with the sheet edge stopper columns 61 and thereby can be moved smoothly vertically. Consequently, the stack disturbance of the sheets 60 can be prevented also when the offset tray 11 is moved vertically.

Therefore, it becomes possible to offer a sheet post-processing device 1 that can prevent the stack disturbance of the sheets 60 both when the offset tray 11 is moved horizontally and when the offset tray 11 is moved vertically.

With the sheet post-processing device 1 of the present embodiment, the friction rollers 62 as the linking means are disposed at a right angle to, and in touch with, the sheet edge stopper columns 61 integrally with the offset tray plate 11*b* of the offset tray 11. Hence, the friction rollers 62 rotate the sheet edge stopper columns 61 by way of contact friction in accordance with the horizontal movement of the of offset tray plate 11*b*.

In addition, the friction rollers 62 are disposed at a right angle to, and in touch with, the sheet edge stopper columns 61 integrally with the offset tray plate 11*b* so as to be freely rotatable. Hence, since when the offset tray 11 is moved vertically, the frictional resistance is weak between the friction rollers 62 and the sheet edge stopper columns 61, the touch of the friction rollers 62 onto the sheet edge stopper columns 61 does not attribute load to the vertical movement of the offset tray 11.

As a result, the friction rollers 62 effect the function as linking means and offers a specific example of the linking means having a simple arrangement.

It should be noted that, as will be explained later, although it is possible to arrange the linking means with engagement means such as gears, since there exists backlash during the horizontal movement of the offset tray plate 11*b* in such a case, the smooth horizontal movement of the offset tray plate 11*b* may be possibly interrupted.

By contrast, as in the present embodiment, when the linking means is arranged with the friction rollers 62, the backlash does not exist. Therefore, there is no delay in the start of the rotation of the sheet edge stopper columns 61 when the offset tray plate 11*b* moves horizontally, and the stack disturbance of the sheets 60 can be surely prevented.

With the sheet post-processing device 1 of the present embodiment, the friction rollers 62 has the flat spring 63 for pressing the sheet edge stopper columns 61. Therefore, the frictional resistance of the friction rollers 62 onto the sheet edge stopper columns 61 is reinforced by the pressure of the flat spring 63 onto the sheet edge stopper columns 61.

Therefore, even if the contact precision to the sheet edge stopper columns 61 is not good enough when the friction rollers 62 are attached, or even if the friction rollers 62 wear off due to a long-term use, the contact can be ensured between the friction rollers 62 and the sheet edge stopper columns 61.

It should be noted that the present invention is by no means restricted to the above embodiment, and may be varied in many ways within the scope thereof. For example, although the linking means is arranged with the friction rollers 62 that are in contact with the sheet edge stopper columns 61 in a pressing state, there is a possible alternative.

Figure 11:
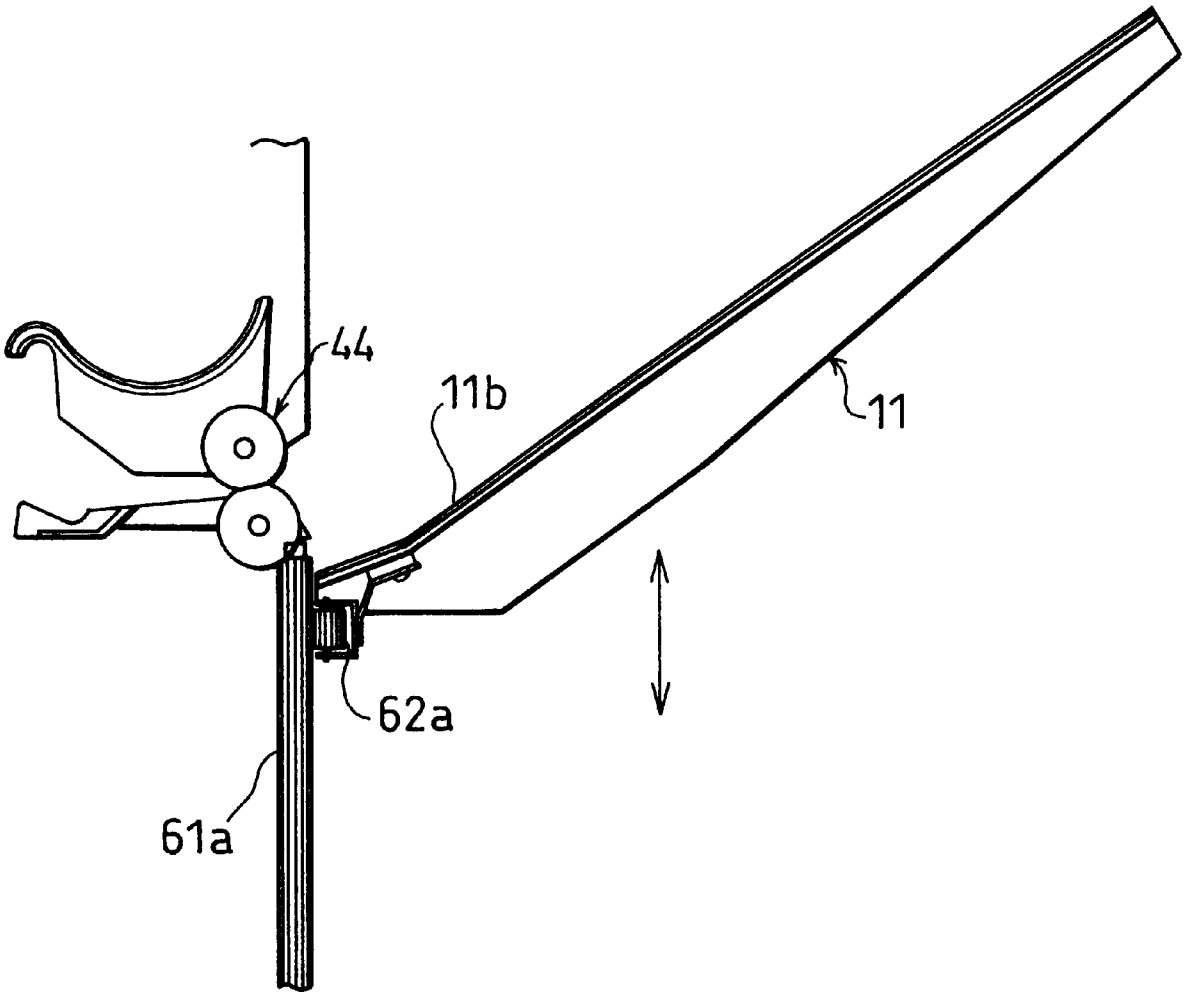
FIG. 11 is a view showing a configuration of gears substituted for the sheet edge stopper column and the friction roller of the sheet post-processing device.

As shown in FIG. 11, it is possible to form the sheet edge stopper column 61*a* from long pinion gears and attach to the offset tray plate 11*b* gears 62*a* such as pinion gears or rack gears that engage with the pinion gears.

This also enables the sheet edge stopper columns 61*a* to be rotated when the offset tray plate 11*b* is moved horizontally, and also enables the offset tray 11 to be moved vertically smoothly when the offset tray 11 is moved vertically.

[Second Embodiment]

Figure 12:
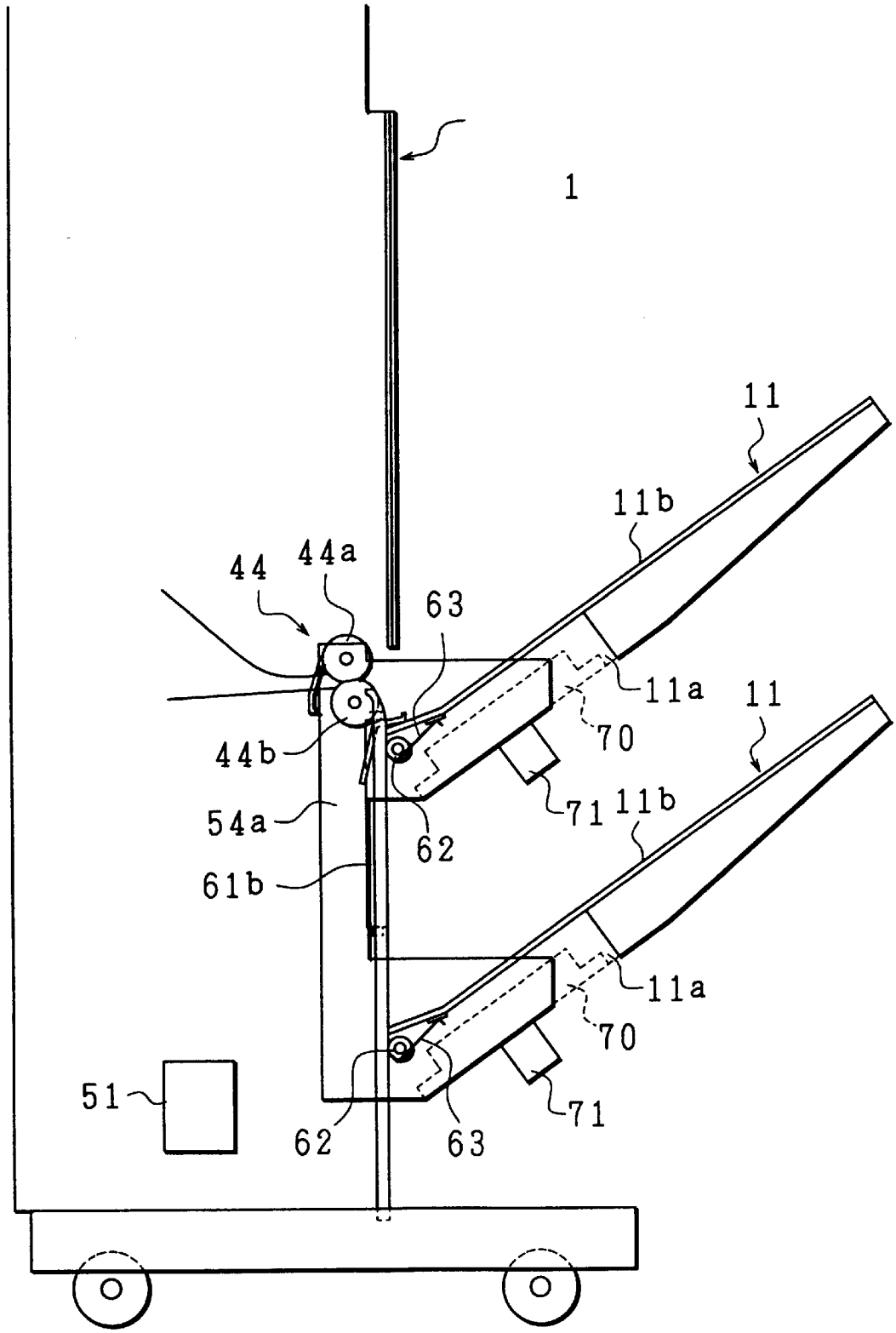
FIG. 12, relating to another embodiment in accordance with the present invention, is a view showing a configuration of a double deck offset tray with the upper deck receiving ejected sheets.
Figure 13:
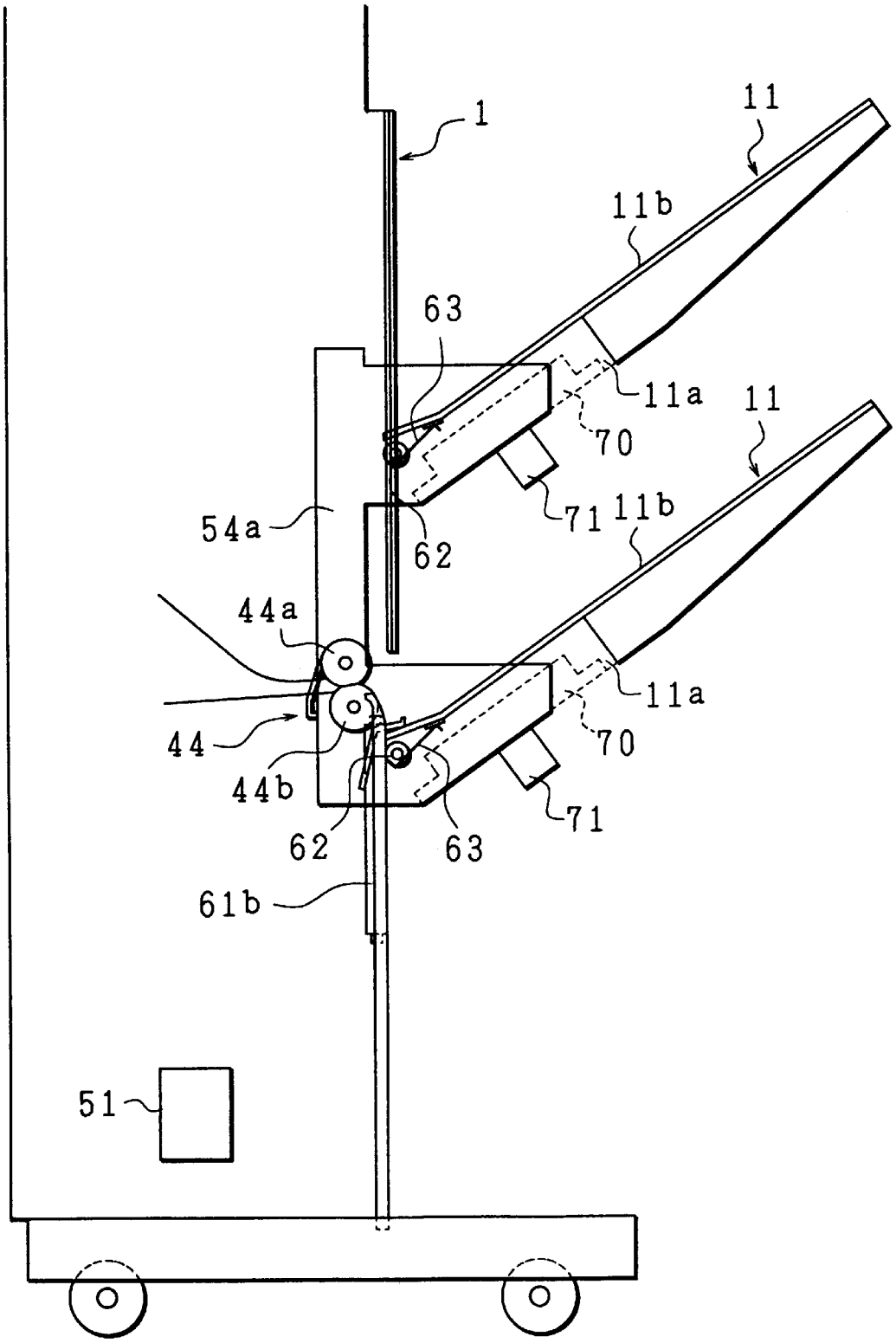
FIG. 13 is a view showing a configuration of the double deck offset tray with the lower deck receiving ejected sheets.
Figure 14:
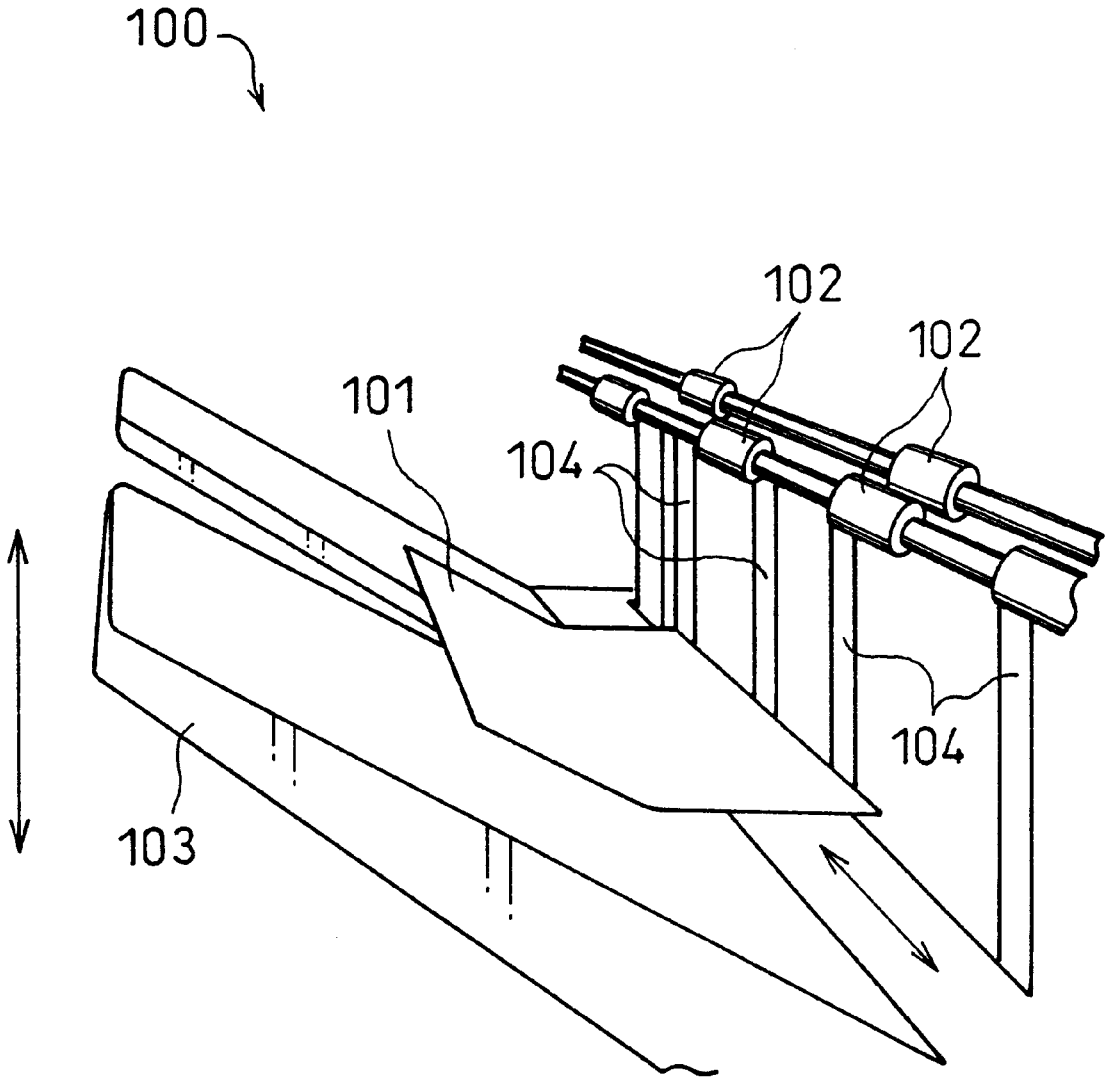
FIG. 14 is a perspective view schematically showing an ejection tray and surroundings thereof of a conventional sheet post-processing device.
Figure 15:
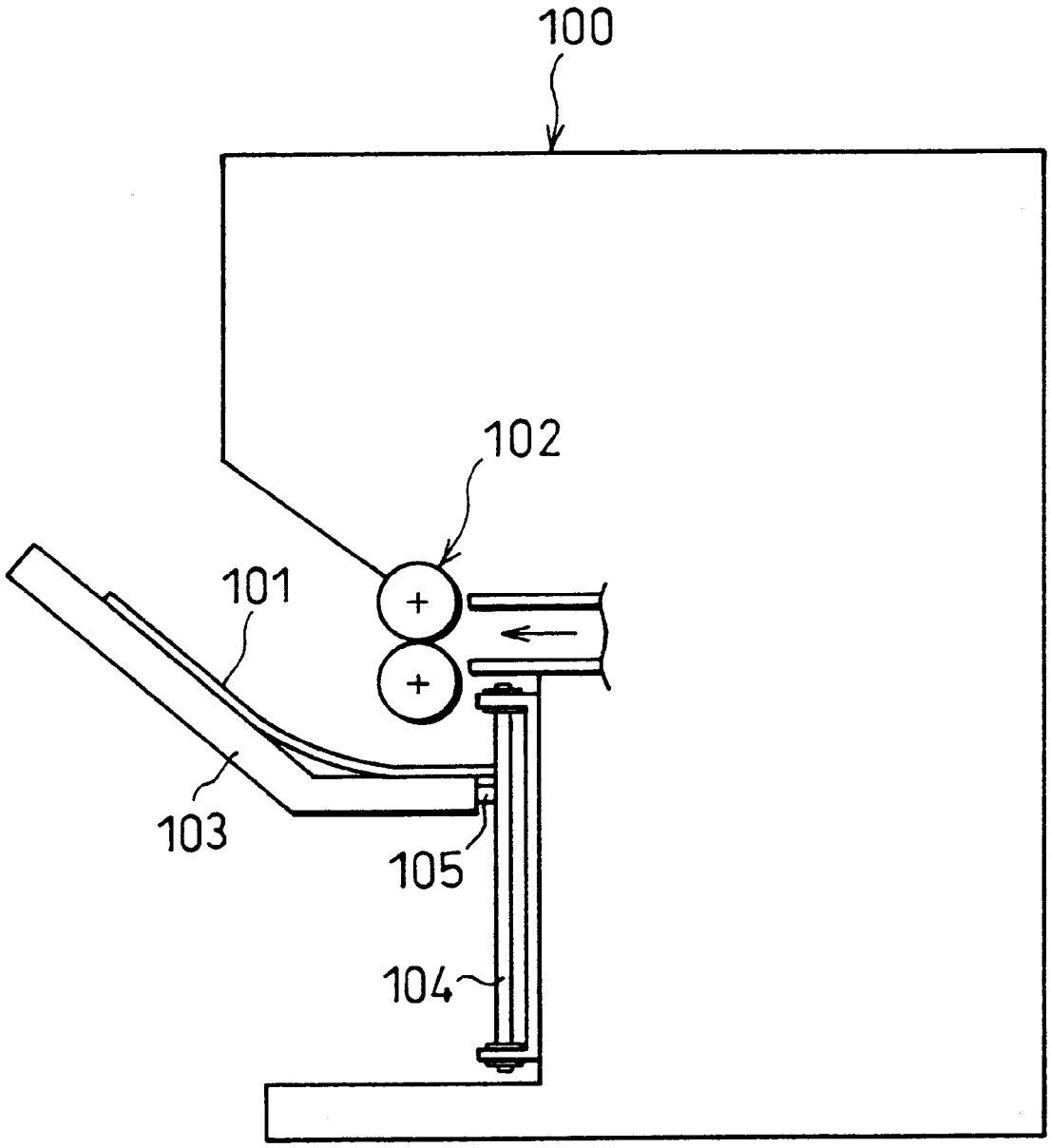
FIG. 15 is a view schematically showing a configuration of a sheet edge stopper column of the conventional sheet post-processing device.

Now referring to FIGS. 12 and 13, the following description will discuss another embodiment in accordance with the present invention. Here, for convenience, members of the present embodiment that have the same arrangement and function as members of the first embodiment, and that are mentioned in the first embodiment are indicated by the same reference numerals and description thereof is omitted.

As shown in FIG. 12, a sheet post-processing device 1 of the present embodiment includes a plurality of offset trays 11, offering a multiple, e.g. two, stage tray. Similarly to the offset tray 11 of the first embodiment, the offset trays 11 here each have an offset tray reinforcement section 11*a* housing a sorting drive section 70 as sorting means. The offset tray plate 11*b* can be reciprocated horizontally and at a right angle to the sheet transportation direction by an offset motor 71

In the present embodiment, the offset trays 11 are made integral by offset tray support plates 54*a* provided on both sides of the offset trays 11, and therefore can be moved integrally and vertically by a lifting and lowering motor 51. It should be noted that although the offset trays 11 form two stages in the present embodiment, three, four and other number of stages may be possible.

Similarly to the first embodiment, the offset trays 11 are each provided with friction rollers 62 and a flat spring 63 for pressing sheet edge stopper columns 61*b*.

The sheet edge stopper columns 61*b* of the present embodiment are shorter than the sheet edge stopper columns 61 of the first embodiment.

As shown in FIG. 12, when a sheet is ejected onto the upper offset tray 11, the sheet edge stopper columns 61*b* only need be long enough for the vertical movement of the upper offset tray 11.

On the other hand, as shown in FIG. 13, when a sheet is ejected onto the lower offset tray 11, the sheet edge stopper columns 61*b* only need be long enough for the vertical movement of the lower offset tray 11.

Consequently, the offset trays 11 forming two stages has an advantage of shorter sheet edge stopper columns 61*b* over those forming one stage.

As explained above, the sheet post-processing device 1 of the present embodiment includes a plurality of offset trays 11 forming two stages, which can be moved integrally and vertically.

Therefore, the inclusion of a plurality of sortable and vertically movable offset trays 11 enables the offset trays 11 to be used according to various ejection modes such as those for copied sheets, printed sheets, or faxed sheets ejected from the copying machine 2. As a result, the sheets 60 can be divided between the offset trays 11 and sorted according to the image forming modes.

Moreover, although the offset tray 11 form multiple stages, since the multiple stages are moved integrally, the sheet edge stopper columns 61*b* only need be long enough for the vertical movement of one of the offset trays 11. Therefore, manufacturing costs can be cut down.

A first sheet post-processing device in accordance with the present invention conducts post processing on sheets ejected from an image forming apparatus and then ejects the sheets onto an ejection tray, and meanwhile sorts the sheets with sorting means reciprocating the ejection tray horizontally and at a right angle to the ejection direction of the sheets when the sheets are ejected onto the ejection tray, aligns the trailing edges of the sheets ejected onto the ejection tray disposed diagonally upward with respect to the ejection direction with a plurality of sheet edge stopper columns erected to be freely rotatable, and lifts and lowers the ejection tray with a lifting and lowering means along the sheet edge stopper columns, and is characterised in that it includes linking means for rotating the sheet edge stopper columns in accordance with a horizontal movement of the ejection tray and that as to the horizontal movement and the vertical movement of the ejection tray, the liking means transmits a driving force to the sheet edge stopper columns only when the ejection tray is moved horizontally.

With the first sheet post-processing device, the sheets ejected from the image forming apparatus undergo post processing and are ejected onto the ejection tray. Moreover, the sorting means reciprocates the ejection tray horizontally and at a right angle to the ejection direction of the sheets when the sheets are ejected onto the ejection tray. In this manner, the sheets are sorted since the sheets are stacked alternately shifted to the right and left on the ejection tray.

Moreover, since the ejection tray is disposed diagonally upward with respect to the ejection direction of the sheets, the sheets stacked on the ejection tray slide down due to the weight of their own and finally come in touch with the sheet edge stopper columns erected behind the ejection tray with respect to the sheet ejection direction. As a result, the sheets are aligned at the trailing edges thereof.

Here, when the ejection tray is moved horizontally by the sorting means, the driving force of the linking means is transmitted to the sheet edge stopper columns in accordance with the horizontal movement of the ejection tray, and thus rotates the sheet edge stopper columns. Therefore, the sheets stacked on the ejection tray in touch with the sheet edge stopper columns are moved horizontally by the rotation of the sheet edge stopper columns. The velocity of the horizontal movement of the sheets is equal to the velocity of the horizontal movement of the ejection tray. Therefore, the sheets stacked on the ejection tray are not interrupted from moving horizontally by frictional resistance with the sheet edge stopper columns, and thereby moved horizontally easily in accordance with the horizontal movement of the ejection tray. Consequently, the stack disturbance of the sheets can be prevented when the ejection tray is moved horizontally.

On the other hand, as to the horizontal movement and the vertical movement of the ejection tray, the liking means transmits the driving force to the sheet edge stopper columns only when the ejection tray is moved horizontally. Therefore, when the ejection tray is moved vertically by the lifting and lowering means, the driving force for the vertical movement of the ejection tray is not transmitted to the sheet edge stopper columns.

In other words, the ejection tray and the sheet edge stopper columns lose mutual interconnection as the transmission link is cut off therebetween. Therefore, the ejection tray, when moved vertically, does not have conventionally existent frictional resistance produced by the engagement with the sheet edge stopper columns and thereby can be moved smoothly vertically. Consequently, the stack disturbance of the sheets can be prevented also when the ejection tray is moved vertically.

Therefore, it becomes possible to offer a sheet post-processing device that can prevent the stack disturbance of the sheets both when the ejection tray is moved horizontally and when the ejection tray is moved vertically.

In order to solve the above problem, a second sheet post-processing device in accordance with the present invention, incorporating all the features of the first sheet post-processing device, is arranged so that the linking means includes freely rotatable friction rollers provided integrally to the ejection tray, the friction rollers being disposed at a right angle to the sheet edge stopper columns and rotating the sheet edge stopper columns by contact friction when the ejection tray is moved horizontally.

With the second sheet post-processing device, the friction rollers as the linking means are disposed at a right angle to, and in touch with, the sheet edge stopper columns integrally with the ejection tray. Hence, the friction rollers rotate the sheet edge stopper columns by way of contact friction in accordance with the horizontal movement of the ejection tray.

In addition, the friction rollers are disposed at a right angle to, and in touch with, the sheet edge stopper columns integrally with the ejection tray so as to be freely rotatable. Hence, since when the ejection tray is moved vertically, the frictional resistance is weak between the friction rollers and the sheet edge stopper columns, the touch of the friction rollers onto the sheet edge stopper columns does not attribute load to the vertical movement of the ejection tray.

As a result, the friction rollers effect the function as linking means and offers a specific example of the linking means having a simple arrangement.

It should be noted that although it is possible to arrange the linking means with engagement means such as gears, since there exists backlash during the horizontal movement of the ejection tray in such a case, the smooth horizontal movement of the ejection tray may be possibly interrupted.

By contrast, when the linking means is arranged with the friction rollers as in the case of the second sheet post-processing device, the backlash does not exist. Therefore, there is no delay in the start of the rotation of the sheet edge stopper columns when the ejection tray is moved horizontally, and the stack disturbance of the sheets can be surely prevented.

In order to solve the above problem, a third sheet post-processing device in accordance with the present invention, incorporating all the features of the second sheet post-processing device, is arranged so that the friction rollers are provided with pressing means for pressing the sheet edge stopper columns.

With the third sheet post-processing device of the present embodiment, the friction rollers has the pressing means for pressing the sheet edge stopper columns. Therefore, the frictional resistance of the friction rollers onto the sheet edge stopper columns is reinforced by the pressure of the pressing means onto the sheet edge stopper columns.

Therefore, even if the contact precision to the sheet edge stopper columns is not good enough when the friction rollers are attached, or even if the friction rollers wear off due to a long-term use, the contact can be ensured between the friction rollers and the sheet edge stopper columns In order to solve the above problem, a fourth sheet post-processing device in accordance with the present invention, incorporating all the features of one of the first, second, and third sheet post-processing devices, is arranged so that the ejection tray is provided to form multiple stages movable integrally and vertically.

The fourth sheet post-processing device includes a plurality of ejection trays forming multiple stages, which can be moved integrally and vertically.

Therefore, the inclusion of a plurality of sortable and vertically movable ejection trays enables the ejection trays to be used in various ejection modes, such as those for copied sheets, printed sheets, or faxed sheets ejected from the copying machine. As a result, the sheets can be divided between the ejection trays and sorted according to the image forming modes.

Moreover, although the ejection tray form multiple stages, since the multiple stages are moved integrally, the sheet edge stopper columns only need be long enough for the vertical movement of one of the ejection trays. Therefore, manufacturing costs can be cut down.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A sheet post-processing device, comprising:

ejection means, provided vertically movable, onto which a sheet on which an image is already formed is ejected after undergoing post processing;

sorting means for sorting the sheet on the ejection means by reciprocating the ejection means horizontally and at a right angle to an ejection direction of the sheet;

sheet edge stopper columns, provided to be horizontally freely rotatable, for aligning a trailing edge of the sheet ejected onto the ejection means disposed diagonally upward with respect to the ejection direction; and linking means for rotating the sheet edge stopper columns in accordance with a horizontal movement of the ejection means so as to horizontally move the sheets already aligned, and, when the ejection means is moved vertically, lifting and lowering the ejection means in a manner causing little friction between the linking means and the sheet edge stopper columns without rotating the sheet edge stopper columns, wherein the linking means includes freely rotatable friction rollers provided integrally to the ejection means, the linking means being disposed at a right angle to, and in touch with, the sheet edge stopper columns, and rotating the sheet edge stopper columns when the ejection means is moved horizontally.

2. The sheet post-processing device as defined in claim 1, wherein the ejection means includes pressing means for pressing the friction rollers onto the sheet edge stopper columns.

3. The sheet post-processing device as defined in claim 2, wherein the ejection means includes ejection trays movable integrally and vertically.

4. The sheet post-processing device as defined in claim 1, wherein the ejection means includes ejection trays movable integrally and vertically.

5. The sheet post-processing device as defined in claim 1, wherein the ejection means includes ejection trays movable integrally and vertically.

6. A sheet post-processing device, comprising:

ejection means, provided vertically movable, onto which a sheet on which an image is already formed is ejected after undergoing post processing;

sorting means for sorting the sheet on the ejection means by reciprocating the ejection means horizontally and at a right angle to an ejection direction of the sheet;

sheet edge stopper columns, provided to be horizontally freely rotatable, for aligning a trailing edge of the sheet eiected onto the ejection means disposed diagonally upward with respect to the ejection direction; and linking means for rotating the sheet edge stopper columns in accordance with a horizontal movement of the ejection means so as to horizontally move the sheets already aligned, and, when the ejection means is moved vertically, lifting and lowering the ejection means in a manner causing little friction between the linking means and the sheet edge stopper columns without rotating the sheet edge stopper columns, wherein the sheet edge stopper columns are pinion gears, and the linking means is integrally provided with the ejection means and is a gear which is in mesh with the pinion gears.

7. A sheet post-processing device for conducting post processing on a sheet ejected from an image forming apparatus and then ejecting the sheet onto an ejection tray, and meanwhile for sorting the sheet with sorting means reciprocating the ejection tray horizontally and at a right angle to an ejection direction of the sheet when the sheet is ejected onto the ejection tray, aligning a trailing edge of the sheet ejected onto the ejection tray disposed diagonally upward with respect to the ejection direction with a plurality of sheet edge stopper columns erected to be freely rotatable, and lifting and lowering the ejection tray with a lifting and lowering means along the sheet edge stopper columns, the sheet post-processing device comprising linking means for rotating the sheet edge stopper columns in accordance with a horizontal movement of the ejection tray and for lifting and lowering the ejection tray in a manner causing little friction between the linking means and the sheet edge stopper columns when the ejection tray is moved vertically, and as to the horizontal movement and the vertical movement of the ejection tray, the linking means transmits a driving force to the sheet edge stopper columns only when the ejection tray is moved horizontally, wherein the linking means includes freely rotatable friction rollers provided integrally to the ejection tray, the friction rollers being disposed at a right angle to the sheet edge stopper columns and rotating the sheet edge stopper columns by contact friction when the ejection tray is moved horizontally.

8. The sheet post-processing device as defined in claim 7, wherein the friction rollers are provided with pressing means for pressing the sheet edge stopper columns.

* * * * *